US005799234A

United States Patent [19]

Furuya et al.

[11] Patent Number: 5,799,234

[45] Date of Patent: Aug. 25, 1998

[54] DEVELOPING APPARATUS USING A DUAL COMPONENT DEVELOPER

[75] Inventors: Nobumasa Furuya; Shigehito Ando, both of Ashigarakami-gun, Japan

[73] Assignee: Fuji Xerox Co., Ltd., Tokyo, Japan

[21] Appl. No.: 791,164

[22] Filed: Jan. 30, 1997

[30] Foreign Application Priority Data

Feb. 2, 1996 [JP] Japan ..... 8-040380

[51] Int. Cl.[6] ..... G03G 15/09

[52] U.S. Cl. ..... 399/277; 399/267

[58] Field of Search ..... 399/267, 270, 399/271, 272, 276, 277, 222, 265, 252; 430/108, 106.6

[56] References Cited

U.S. PATENT DOCUMENTS

| | | | |
|---|---|---|---|
| 4,851,874 | 7/1989 | Ogiyama | 399/276 X |
| 4,896,625 | 1/1990 | Sakamoto et al. | 399/267 |
| 5,319,337 | 6/1994 | Matsunari et al. | 399/267 X |
| 5,360,940 | 11/1994 | Hays | 399/270 X |
| 5,574,545 | 11/1996 | Hosoi et al. | 399/270 |

FOREIGN PATENT DOCUMENTS

| | | |
|---|---|---|
| A-55-138765 | 10/1980 | Japan . |
| A-57-2068 | 1/1982 | Japan . |
| A-59-181372 | 10/1984 | Japan . |
| A-3-259276 | 11/1991 | Japan . |

*Primary Examiner*—Sandra L. Brase
*Attorney, Agent, or Firm*—Oliff & Berridge, PLC

[57] ABSTRACT

A developing apparatus comprises: a developer support being disposed in the proximity of or in contact with an image support having a surface on which an electrostatic latent image is formed, the developer support having a peripheral surface supported turnably; and a developing bias power supply for supplying a developing bias voltage between the developer support and the image support, wherein a dual component developer including toner and magnetic carriers is supported on the peripheral surface of the developer support to be transported, and the toner is transferred to the image support in an electric field formed at a position where the image support faces the developer support for forming a toner image, and the developer support has a plurality of magnetic poles for attracting almost one layer of the carriers on the peripheral surface of the developer support almost uniformly.

19 Claims, 25 Drawing Sheets

CHARGE EXPOSE DEVELOP

DEVELOPING APPARATUS USING A DUAL COMPONENT DEVELOPER

BACKGROUND OF THE INVENTION

This invention relates to a developing apparatus used with an electrophotographic recorder, an electrostatic recorder, or the like for selectively transferring toner to a latent image produced by the electrostatic potential difference for visualization and in particular to a developing apparatus using a dual component developer comprising carriers and toner mixed.

Electrophotographic or electrostatic systems are widely used as image formation systems such as copiers and printers. Such a system forms an electrostatic latent image on an image support and transferring toner to the electrostatic latent image for visualization, then transferring the toner image to recording paper, etc.

Developing apparatuses for developing an electrostatic latent image on an image support includes a so-called contact-type dual component developing apparatus for bringing a dual component developer consisting of toner and magnetic carriers into contact with the surface of the image support and transferring toner thereto, thereby developing an image. This developing apparatus involves problems of necessity for controlling the toner concentration in the developer and necessity for an agitation mechanism of the developer, upsizing the apparatus. However, it has excellent features in an image quality characteristic, transportability of the developer, etc., and becomes mainstream.

FIG. 33 is a schematic diagram to show a configuration example of the contact-type dual component developing apparatus. The contact-type dual component developing apparatus has a developing roll 401 comprising a magnet roll 401*a* and a sleeve 401*b* rotating round the periphery of the magnet roll. It also comprises a supply member 402 for supplying a dual component developer to the peripheral surface of the sleeve 401*b* and a layer thickness regulation member 403 called a trimmer for forming a developer layer of a proper thickness on the sleeve. The developer layer thus formed forms a magnetic brush comprising carriers like an ear according to a magnetic field produced by the magnet roll 401*a* and comes in contact with an image support 410 at a position facing the image support 410 for transferring only toner.

In the contact-type dual component developing apparatus, the magnetic brush of the developer makes mechanically sliding contact with the surface of the image support 410, thus image quality defects such as a brush trace and sweep spots caused by the magnetic brush easily occur. Then, to avoid the defects, a large number of so-called noncontact-type dual component developing apparatuses are also proposed for developing without bringing a developer into contact with the surface of an image support.

However, to use a layer thickness regulation member as described above, a condition filled with an excessive developer occurs in the rear portion of the layer thickness regulation member, namely, upstream in the developer transport direction, so that a strong compression force acts on the developer. When the developer passes through the gap between the layer thickness regulation member and a developer support, a strong friction force also acts on the developer. Such forces cause the developer to be degraded.

The degradation of the developer is roughly classified into toner degradation and carrier degradation, which are caused by the compression force, friction force, etc. A representative degradation form and the degradation effects of toner and carriers are as follows:

Generally, an external additive added for improving a charge property and fluidity adheres to the toner surface. When a compression force or friction force acts on the developer, the external additive peels off from the toner surface or is buried in toner resin. The condition of peeling off or burying of the external additive is a representative form of toner degradation. When such degradation develops, the friction charge characteristic changes and a charge amount distribution of toner becomes extremely wide and unstable. Thus, toner having a low charge amount and toner charged to a polarity opposite to a predetermined polarity, which will be hereinafter referred to as opposite polarity toner, occur, causing fogging the background.

When toner degradation as mentioned above occurs, the contact area between toner and carriers increases, so that the adhesion force between the toner and carriers grows. Thus, the toner becomes hard to peel off from the carriers and the developed toner amount decreases, lowering the image density. Particularly in the noncontact-type dual component developing apparatus, there is no adhesion force between toner and the image support, thus toner peels off from the carrier surfaces when a Coulomb force acting on the toner due to an electric field surpasses the adhesion force between the toner and carriers. Therefore, the image density remarkably lowers due to an increase in the adhesion force between the toner and carriers as toner degradation occurs. When toner degradation thus causes image defects to occur, it means that the life of the developer reaches the end; the developer needs to be replaced.

On the other hand, carriers are degraded due to fixation of toner on the carrier surfaces and an external additive to the toner. When such carrier degradation occurs, the same material as the toner exists on the carrier surfaces, thus the friction charge ranking difference between the toner and carriers lessens as compared with the state before the degradation. Therefore, the charge amount of toner decreases with the carrier degradation and toner having a low charge amount and opposite polarity toner occur, causing fogging the background.

The dual component developing apparatus using the layer thickness regulation member involves the following problem:

To use a trimmer made of a nonmagnetic or magnetic material, the developer transport amount depends on the gap between the layer thickness regulation member and the developer support surface and the positional relationship among magnetic poles of the developer support. Thus, the dimension accuracy and setting accuracy of the layer thickness regulation member largely affect the image quality. Therefore, to provide good images, the gap needs to be set with extremely high accuracy. Thus, the layer thickness regulation member needs to be worked and installed at much expense in time and effort, increasing manufacturing costs of the apparatus.

Particularly, recent image formation systems are demanded for developing excellent in resolution, fine line reproductivity, etc., developing a low-potential latent image, and providing high developing efficiency in a high-speed process. In such cases, the above-mentioned problem becomes more remarkable. That is, it is desired to narrow the developing gap, namely, the gap between the developer support and image support, in which case the developer layer must be made a thin layer with a smaller transport amount. Thus, it is necessary to furthermore narrow the gap between the layer thickness regulation member and developer support surface; however, the narrower the gap, the larger the effect of the dimension accuracy and setting accuracy of the layer thickness regulation member on the image quality. The narrower the gap, the larger the compression force or friction force acting on the developer, thus promoting degradation of the developer.

SUMMARY OF THE INVENTION

It is therefore an object of the invention to provide a developing apparatus capable of forming a uniformly thin layer of a developer without mechanically regulating the thickness of the developer layer, thereby decreasing degradation of the developer for providing good images stably.

Configuration for Forming a Magnetic Field on Periphery of Developer Support To solve the problems, the developer support for supporting and transporting a dual component developer on the peripheral surface comprises a plurality of magnetic poles for attracting almost one layer of carriers on the peripheral surface of the developer support almost uniformly. The magnetic poles are set so as to be able to form a carrier layer as mentioned above by properly selecting the strength of the magnetic field to be generated and a magnetic pole spacing. For example, if the distance between the adjacent magnetic poles magnetized in the vicinity of the peripheral surface of the developer support is set to about 25 μm–250 μm and the magnetic poles are magnetized as an alternating pattern of S and N poles, only almost one layer of generally used carriers about 25 μm–200 μm in particle diameter can be attracted almost uniformly.

To provide the magnetic poles, a magnetic layer may be formed on the peripheral surface of the developer support and be magnetized or a non-magnetic layer may be laminated on the magnetized magnetic layer. The developer support may comprise an outer peripheral member having an endless peripheral surface turning and an internal member disposed in the outer peripheral member and the magnetic poles may be disposed in the vicinity of the peripheral surface of the internal member.

The principle for such magnetic poles to form an almost uniform thin film of carriers can be concluded as follows:

Since each magnetic force line produced by the magnetic poles placed in a narrow spacing as described above heads for the adjacent magnetic pole having a different polarity, the magnetic field component in a direction perpendicular to the surface of the developer support is rapidly attenuated in the proximity of the surface of the developer support. When a magnetic carrier layer is formed on the peripheral surface of the developer support, the magnetic force lines pass through the inside of the magnetic carrier layer coming in contact with the peripheral surface of the developer support and are little distributed on the outside of the magnetic carrier layer. Therefore, the carriers do not concentratedly adhere to parts on the magnetic poles and are attracted in a state in which only almost one layer of the carriers is arranged orderly along the magnetic field. Thus, the developer adheres fully to the entire peripheral surface of the developer support and a thin developer layer having no projections or depressions is formed on the developer support and is held by the magnetic force and transported to a developed area.

Preferably, the magnetic carriers of the developer used with the developing apparatus have magnetization in a magnetic field of $10^6/(4\pi)$ A/m ranging from 45 kA/m to 360 kA/m.

If magnetization of the magnetic carriers is small, the force for attracting the magnetic carriers on the developer support by the action of the magnetic field formed by the magnetic poles lessens. Thus, if the magnetic pole spacing is set small and the magnetic field component in the direction perpendicular to the surface of the developer support is rapidly attenuated, a portion where the carriers are not attracted on the surface of the developer support (incomplete developer layer part) easily occurs. If such an incomplete developer layer part exists, density inconsistencies in low-density portions or a reproductivity failure of fine lines occurs.

On the other hand, if magnetization of the magnetic carriers is large, a strong attraction force acts in response to the magnetic pole pattern of the developer support and it becomes difficult to form an almost uniform developer layer on and between the magnetic poles, namely, a developer layer with no projections and depressions. If the developer layer has such projections and depressions, density inconsistencies corresponding to the magnetic pole pitches will occur in the low-density portions or minute inconsistencies will be produced in the widths of fine lines.

Thus, the magnetization of the magnetic carriers affects the state of the developer layer formed by the magnetic poles and the magnitude of the magnetization is placed in the above-mentioned range, thereby facilitating formation of almost one developer layer on the developer support.

Since the developing apparatus can form a thin developer layer by the action of the magnetic poles disposed on the developer support without using a layer thickness regulation member, a large load is not imposed on the developer and degradation of the developer can be prevented. Since a developer layer is formed only by the magnetic force of the developer support, the developer transport amount does not depend on the parts accuracy and change with time does not occur. Further, the magnetic pole spacing is set sufficiently narrow, so that the effect of the magnetic pole pattern does not occur and highly uniform images can be provided. Since the magnetic carriers form a bridge like a closed magnetic circuit between the magnetic poles, a strong magnetic binding force acts on the carrier layer on the developer support. Therefore, developer scattering and carrier deposition on an electrostatic latent image support do not occur.

The developer support used with the developing apparatus can have a main section consisting of a conductive layer and a magnetic recording layer formed thereon, the above-mentioned magnetic poles being disposed on the magnetic recording layer. A developing bias voltage is applied to the conductive layer and an electric field is formed between the developer support and a latent image on the image support, thereby transferring toner to the latent image.

The magnetic recording layer is magnetized by a magnetization head. A soft magnetic layer is disposed below the magnetic recording layer, whereby magnetization can be applied so as to produce N and S poles in the thickness direction of the magnetic recording layer and strong magnetic poles can be provided. Since the soft magnetic layer defines a magnetic flux passage, when magnetization is applied to the magnetic recording layer in the direction perpendicular to the surface of the developer support, the magnetization head for magnetizing the magnetic recording layer is placed only on the magnetic recording layer side and a magnetic flux passage from the magnetization head perpendicularly through the magnetic recording layer to the rear soft magnetic layer can be formed.

The soft magnetic layer is made of a material magnetized upon placement in a magnetic field, but showing no magnetism in a state in which an external magnetic field does not act.

The developer support may be formed with the magnetic poles almost equally spaced from each other over all area in the turn direction with the magnetized portion turned, or may comprise an internal member formed with the magnetic poles and an outer peripheral member turning around the periphery of the internal member. With the developer support having the inner and outer peripheral members, the magnetic poles are placed in at least the developer layer formation portion of the internal member on the developer support and a thin layer of the developer can be formed on the peripheral surface of the outer member by the magnetic field produced by the magnetic poles. As the outer peripheral member rotates, the developer is transported and is made to approach or come in contact with the image support in the developing area for forming a toner image. In such a developer support, any desired magnet pattern is applied to portions other than the developer layer formation portion and an optimum magnet pattern is used to meet the requirements of the image quality, image formation speed, etc.

An art for forming a developer support with magnetic poles at small pitches as in the above-mentioned configuration is disclosed in Japanese Patent Laid-Open No. Hei-3-259276.

In the art described here, a developing roll (developer support) is made of a single rotation body and is formed on a peripheral surface with magnetic poles at small pitches of about 100 μm or less and a mono component magnetic developer is attracted on the peripheral surface, whereby occurrence of inconsistencies in attracted developer amount in response to magnetic pole positions is reduced and the developer layer is made available for forming a toner image in a developing area. Thus, developing with no density inconsistencies is executed in such a simple configuration without adopting a structure of a fixedly supported magnet roll and a sleeve rotating around the periphery of the magnet roll for the developing roll.

However, the developing apparatus described in Japanese Patent Laid-Open No. Hei 3-259276 assumes use of a mono component magnetic developer, which is 7–15 μm in particle diameter; if the magnetization pitch is set to about 100 μm or less, an attracted developer becomes like ears on the peripheral surface of the developing roll. Thus, unless the height of the ears is regulated mechanically by a layer thickness regulation member, a uniform developer layer cannot be formed; the developing apparatus assumes use of the layer thickness regulation member. The art described in Japanese Patent Laid-Open No. Hei 3-259276 differs from the invention in handled developer and purpose and is based on an entirely different technical philosophy.

Configuration for Forming an Electric Field on Periphery of Developer Support An electric field for attracting almost one layer of carriers on the peripheral surface of a developer support almost uniformly is formed another means to solve the problems. For example, the electric field formation means comprises a plurality of linear or elongated electrodes disposed on the peripheral surface of the developer support and a power supply unit for applying a voltage between the adjacent electrodes. Preferably, the distance between the adjacent electrodes is in the range of 25 μm to 200 μm and the voltage is applied so as to produce a potential difference of about 0.8 V/μm or more between the adjacent electrodes.

An electric field is formed along the peripheral surface of the developer support as mentioned above, whereby the carriers existing on the periphery have positive and negative polarities induced and polarize. The carriers are attracted on the peripheral surface of the developer support by an electric force, forming a thin layer of the developer together with toner adhering to the carriers. At this time, the electric force lines between the adjacent electrodes almost pass through the carriers made of high-resistance material and little appear on the outside of the carrier layer coming in contact with the developer support. Thus, almost one carrier layer is formed on the peripheral surface of the developer support almost uniformly. This developer layer is transported to a developing area facing an image support for forming a toner image.

Therefore, an almost uniform developer layer can be formed without mechanically regulating the thickness of the developer layer by a layer thickness regulation member, thereby avoiding degradation of the developer at the developer layer formation time. Further, the thickness of the developer layer does not depend on the parts accuracy. Thus, developing of high picture quality can be executed stably.

The electrodes disposed along the peripheral surface of the developer support may be formed in the turn direction or spirally if a proper distance is set between the adjacent electrodes; preferably they are formed like lines or elongated bands parallel with a direction at right angles to the turn direction.

The electrodes are disposed in the direction at right angles to the turn direction and are placed so as to move as the peripheral surface of the developer support turns, and the direction of an electric field between the adjacent electrodes can be cyclically inverted downstream from the position where the developer support faces the image support. The electric field direction is thus inverted cyclically, whereby the polarity induced to carriers is also inverted and the carriers are stripped off from the peripheral surface of the developer support.

Therefore, the developer passing through the developing area can be stripped off from the peripheral surface of the developer support without using mechanical means such as a scraper, then a new developer can be supplied. Thus, occurrence of degradation at the developer stripping off time can be prevented and change of the toner image quality provided by developing with time can be decreased.

An art for providing a plurality of electrodes along the peripheral surface of the developer support as in the above-mentioned configuration is disclosed in Japanese Patent Laid-Open Nos. Sho 55-138765, 57-2068, and 59-181372.

A magnetic brush developing apparatus disclosed in Japanese Patent Laid-Open No. Sho 55-138765 uses mono component toner and has a cylindrical magnet having a plurality of magnetic poles and a sleeve rotated around the periphery of the magnet, a plurality of electrically insulated electrodes being exposed on the outer peripheral surface of the sleeve. A voltage is applied between the electrodes or between the electrodes and the sleeve and an electric current is allowed to flow into a mono component developer ranging between the electrodes, whereby the mono component developer is charged to a desired polarity for properly developing an electrostatic latent image.

In a developing method and developing apparatus disclosed in Japanese Patent Laid-Open No. Sho 57-2068, electrode means is formed on the surface of a moving insulating member and a voltage is applied between the electrodes, whereby a large number of convergent electric fields are formed on the surface of a moving insulating member and mono component polarity toner particles are held. The toner is made to approach an image formation member for developing a latent image pattern.

A developing apparatus disclosed in Japanese Patent Laid-Open No. Sho 59-181372 comprises a developer support having a plurality of electrically insulated electrodes from each other and applies an alternating voltage to some of the electrodes and a DC voltage to the remaining electrodes, whereby a non-magnetic mono component developer is vibrated along electric force lines occurring between the adjacent electrodes and is charged by friction between the non-magnetic mono component developer and the developer support.

However, the arts described in Japanese Patent Laid-Open Nos. Sho 55-138765 and 59-181372 assume use of a mono component developer and charges toner or adjusts toner charges by voltage applied to the electrodes and does not involve the technical philosophy of using electrodes as means for forming a uniform thin layer of a developer. The art described in Japanese Patent Laid-Open No. Sho 57-2068 holes a mono component developer on the moving insulating member by an electric field formed between the electrodes, but assumes use of a layer thickness regulation member such as a doctor blade for layer formation. Therefore, it differs from the invention in purpose. The prior arts are thought of as arts entirely different from the invention.

Configuration for Forming Magnetic and Electric Fields on Periphery of Developer Support Configuration for Forming a Magnetic Field on Periphery of Developer Support and Configuration for Forming an Electric Field on Periphery of Developer Support are previously described as the configurations for solving the problems. The following developing apparatus having both the configurations so as to make the most of the advantages and make up the disadvantages can also be adopted:

A developer support comprises an internal member having a plurality of magnetic poles and an outer peripheral member turned around the periphery of the internal member, and the outer peripheral member is formed on the peripheral surface with a plurality of electrodes at narrow pitches. The internal member and the outer peripheral member may be a cylindrical roll and a cylindrical sleeve disposed on the periphery of the roll or may be a cylindrical roll and a belt placed on the roll.

In the configuration, a developer is attracted on the surface of the outer peripheral member by the action of a magnetic filed in a developing area facing an image support and is held electrically in an area downstream from the developing area and the direction of the electric field between the adjacent electrodes in the area can be inverted cyclically, thereby enabling uniform developing with no density inconsistencies in the developing area. That is, the adjacent electrodes differ in polarity to generate an electric field between the electrodes and if the developer support faces the image support in the developing area as it is, the developing bias changes between the electrodes. However, the developer is held by the action of the magnetic field in the developing area, whereby this problem is solved. The developer can be stripped off from the surface of the outer peripheral member by the action of the electric filed downstream from the developing area. Degradation of the developer caused by scraping off the developer by a scraper, etc., does not occur.

In the developing apparatus, preferably the magnetic poles of the internal member are magnetized linearly in the direction at right angles to the turn direction of the developer support and are almost equally spaced from each other in the turn direction, one of the distance between the centers of the adjacent electrodes disposed in the outer peripheral member and the center distance between the adjacent magnetic poles is an integer multiple of the other, and the outer peripheral surface of the internal member and the inner peripheral surface of the outer peripheral member are turned at almost equal travel speed.

In setting so, when the developer attracted on the outer peripheral member by the action of the electric field moves to the area where the magnetic field acts, it makes a smooth transition to a state in which the developer is attracted by the magnetic field action. That is, the developer on the outer peripheral member is not stripped off or scattered from the outer peripheral member and does not largely move on the outer peripheral member; it is maintained as a uniform developer layer, enabling high-quality developing.

The developing apparatus has the internal member provided with the magnetic poles and the outer peripheral member provided with the electrodes, but may have the internal member provided on the peripheral surface with the electrodes and the outer peripheral member provided with the magnetic poles. This configuration can also produce a similar effect. Also in the configuration, preferably one of the magnetic pole spacing in the outer peripheral member and the electrode spacing in the internal member is set to an integer multiple of the other, and the internal member and the outer peripheral member are set to almost equal peripheral surface travel speed.

A magnetic recording layer can also be superposed on electrodes with magnetic poles provided. The magnetic recording layer may be laminated on the electrodes or be formed on the lower layer of the electrodes. The configuration enables the developer to be held on the peripheral surface of the image support by the action of the magnetic field and to be stripped off by the action of the electric field.

DETAILED DESCRIPTION OF THE PREFERRED EMBODIMENTS

Embodiments of the invention will be discussed in the following order:

[1. Image Formation System Using a Developing Apparatus According to the Invention]

Figure 1:
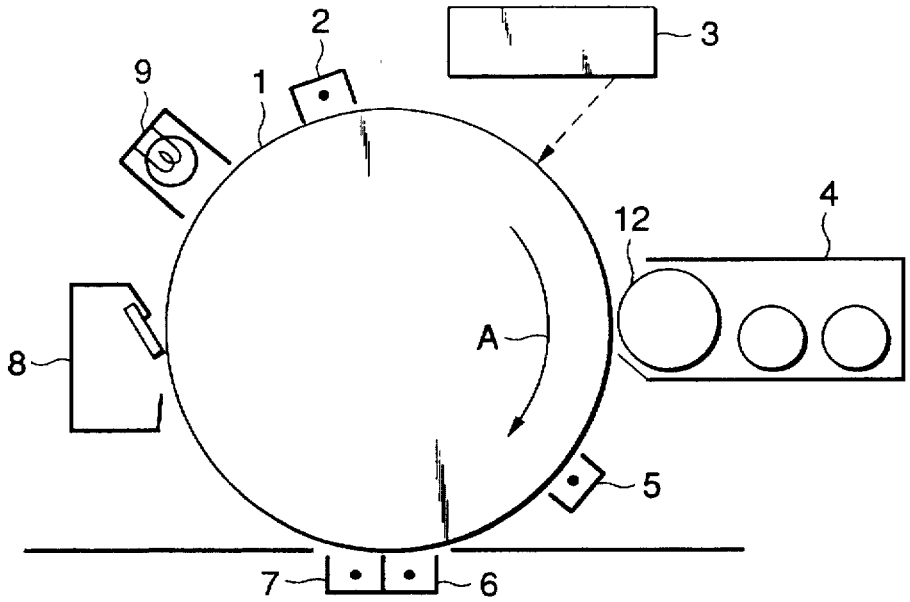
FIG. 1 is a schematic diagram to show a configuration example of an image formation system using a developing apparatus according to the invention.

FIG. 1 is a schematic diagram to show a configuration example of an image formation system using a developing apparatus according to the invention.

This image formation system comprises a photosensitive drum 1 formed with a photosensitive layer on the peripheral surface of an almost cylindrical conductive substrate. This photosensitive drum 1 is rotated in the direction indicated by arrow A shown in FIG. 1. It is surrounded by a charger 2, an exposure unit 3, a developing apparatus 4 having a developer support 12 made of a cylinder member facing the photosensitive drum 1, a before-transfer corotron 5, a transfer corotron 6, a stripping corotron 7, a cleaner 8, and an eraser lamp 9 along the rotation direction of the photosensitive drum 1.

The conductive substrate of the photosensitive drum 1 is electrically grounded. An organic photosensitive body (OPC) negatively charged is used for the photosensitive layer. Upon application of image light after almost uniform charging, charges in the exposure part to the light flow into the conductive substrate and the potential is attenuated.

For example, the photosensitive drum 1 can be set to 100 mm in outer diameter and about 160 mm/s as travel speed of the peripheral surface, namely, the process speed.

The exposure unit 3 has a laser generator blinking based on an image signal and a polygon mirror for rotating and reflecting a laser beam emitted from the laser generator for exposing and scanning the peripheral surface of the photosensitive drum 1 for forming an electrostatic latent image.

The exposure unit 3 may expose an image part or a non-image part and can transfer toner to the image part for visualization by properly selecting a charge polarity of a photosensitive body and a charge polarity of toner. The image formation system uses the photosensitive body and toner negatively charged for exposing the image part.

Next, the operation of the image formation system will be discussed.

Figures 2A, 2B, 2C:
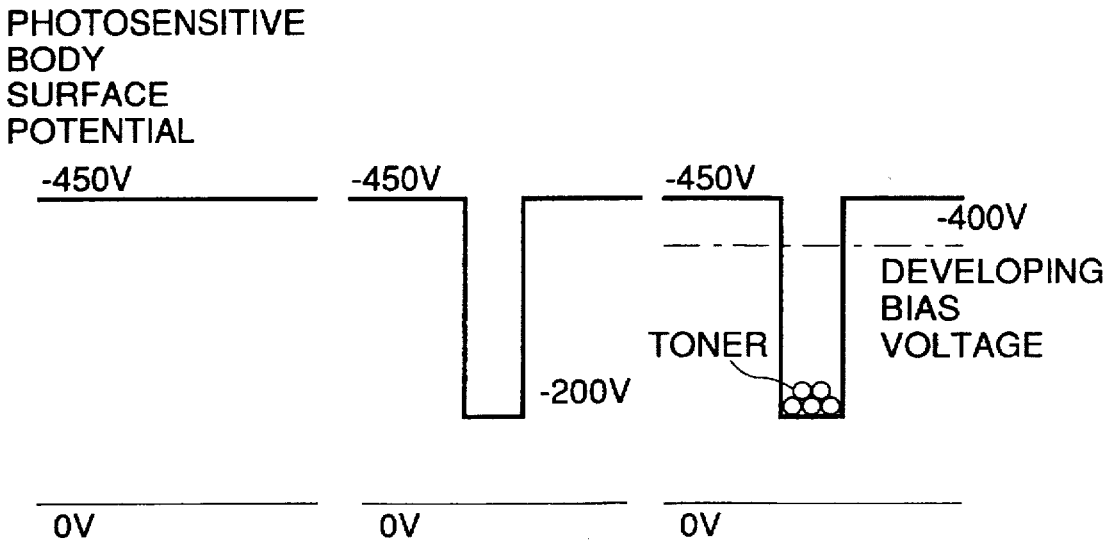
FIGS. 2A–2C are illustrations to show the potential transition on the surface of an image support when a toner image is formed in the image formation system shown in FIG. 1.

First, the surface of the photosensitive drum 1 is charged uniformly to −450 V by the charger 2 [FIG. 2A]. Subsequently, the image part is exposed to laser light and a negative latent image having an exposure part potential of almost −200 V is formed [FIG. 2B]. Toner is transferred to the exposure part of the negative latent image by the developing apparatus 4 for rendering the latent image visible [FIG. 2C].

The toner image formed on the photosensitive drum 1 as mentioned above is transferred onto recording paper by charging the transfer corotron 6. After this, as the stripping corotron 7 is charged, the recording paper is stripped off from the surface of the photosensitive drum 1 and is transported to a fuser (not shown), which then fixes the toner image on the recording paper upon heating and applying pressure.

On the other hand, the surface of the photosensitive drum 1 where transferring the toner image and stripping off the recording paper are complete is cleaned by the cleaner 8 for removing the remaining toner and further the remaining charges are removed by exposure of the eraser lamp 9 for the next image recording process.

The before-transfer corotron 5 disposed downstream from the developing apparatus in the rotation direction of the photosensitive drum 1 is used to examine the amount of carriers transferred to the image support at the developing time; it uniformly negatively charges the toner image formed on the photosensitive drum 1, whereby the carriers transferred onto the photosensitive drum 1 against the intention at developing are negatively charged and are transferred onto recording paper together with toner, so that the carrier transfer amount can be evaluated on the recording paper.

[2. First Embodiment]

<a. Configuration and Operation of Developing Apparatus>

Next, a developing apparatus of a first embodiment of the invention will be discussed.

Figure 3:
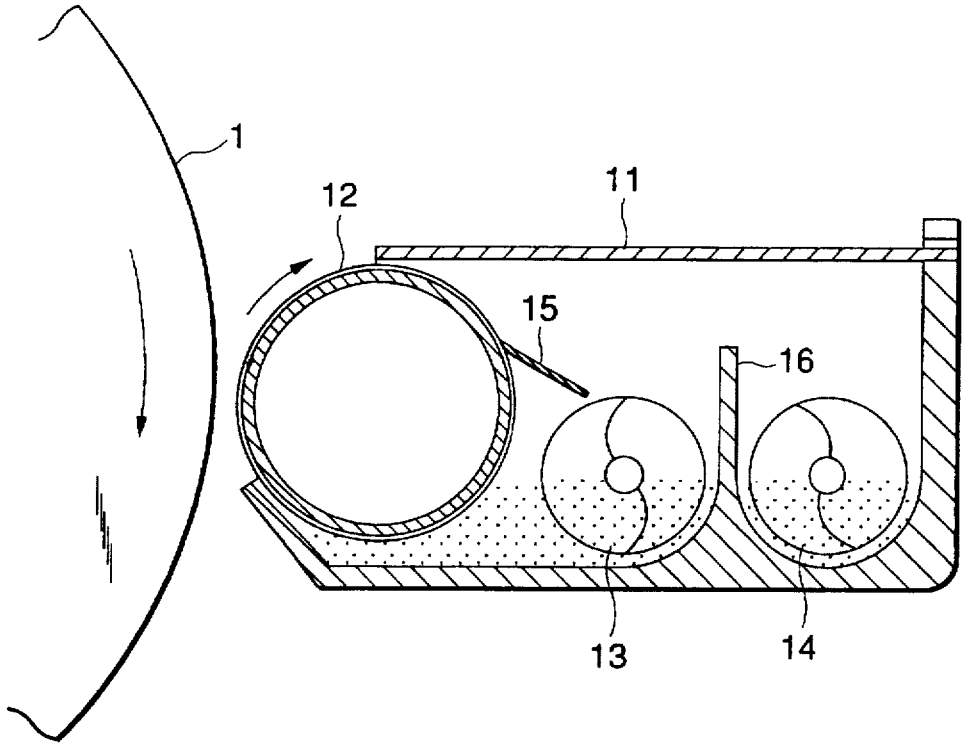
FIG. 3 is a schematic diagram to show the configuration of a developing apparatus of one embodiment of the invention.

FIG. 3 is a schematic diagram to show one form of a developing apparatus that can be used with the above-described image formation system.

The developing apparatus 4 is formed with a developing opening in a part of a developing housing 11 for housing a developer opposite to a photosensitive drum 1 and has a developing roll 12 disposed in the opening and two screw augers 13 and 14 at the rear of the developing roll 12. It also has a scraper 15 for scraping off a developing deposited on the developing roll 12, the scraper 15 being disposed so as to come in contact with the developing roll 12.

The screw augers 13 and 14 are placed in two developer agitation and transport chambers separated by a partition wall 16 in the developing housing 11 and are rotated so as to transport a developer in opposite directions. The two developer agitation and transport chambers communicate with each other at both ends, so that a developer transported by the screw augers 13 and 14 is agitated and circulated through the two developer agitation and transport chambers.

Figure 4:
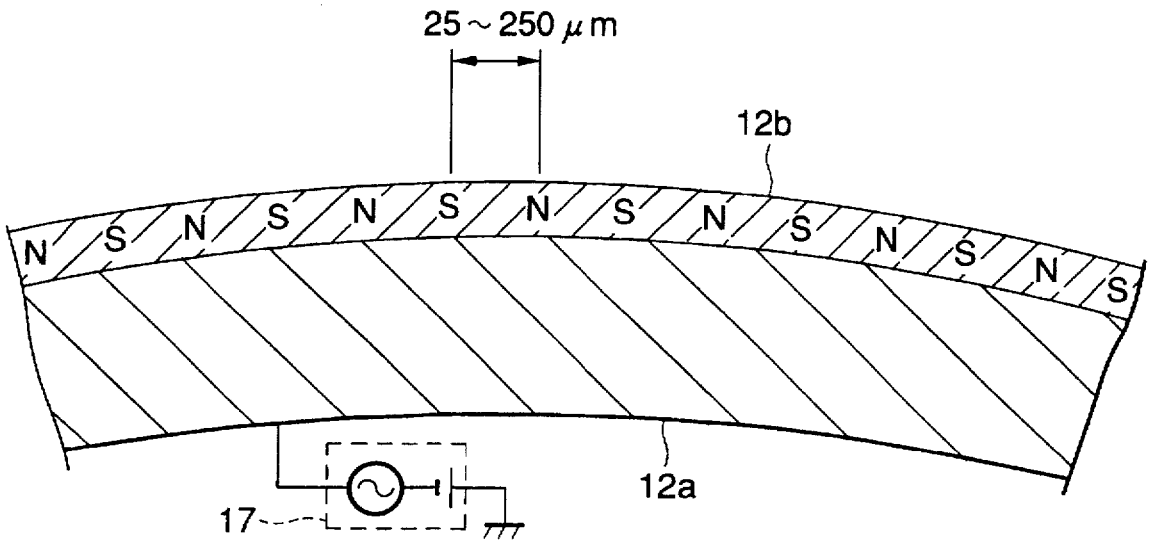
FIG. 4 is a partially enlarged sectional view of a developing roll used with the developing apparatus shown in FIG. 3.

The developing roll 12 has a main section consisting of a cylindrical conductive substrate 12*a* supported for rotation round the axis and a magnetic recording layer 12*b* formed on the peripheral surface of the conductive substrate 12*a*, as shown in FIG. 4. The developing roll 12 is set to 18 mm in outer diameter and 320 mm/s as the peripheral velocity at the drive time and the gap between the photosensitive drum 1 and the developer support 12 is set to 300 μm. A developer layer is held so as to be out of contact with the photosensitive drum 1.

A developing bias voltage is applied to the conductive substrate 12*a* from a developing bias power supply 17. An AC voltage on which a DC voltage is superposed is adopted for the developing bias voltage and has a DC component set to −400 V to prevent background fog from occurring. The AC component of the developing bias voltage is a rectangular wave having a frequency of 6 kHz and has a peak-to-peak voltage set to 1.5 kV.

On the other hand, the magnetic recording layer 12*b* is magnetized with an alternating pattern of S and N poles spaced equally (about 25–200 μm) apart on all the periphery. The magnetization will be discussed later.

The magnetic recording layer 12*b* is formed by applying a coating (50 μm thick) of ferromagnetic material powder dispersed in a binding resin onto the conductive substrate 12*a*; $\gamma$-$Fe_2O_3$ is used as the ferromagnetic material and polyurethane is used as the binding resin. Any known material as a magnet material, magnetic recording material, etc., can be used as the magnetic material. In addition to $\gamma$-$Fe_2O_3$, $CrO_2$, etc., can be used. Any known resin as a resin forming a part of a magnetic recording layer of tape, disk, card, etc., can be used as the binding resin; for example, polycarbonate, polyester, polyurethane, etc., can be used. Further, conductive fine particles, etc., can be added to the magnetic recording layer 12*b* as required.

The developer used with the developing apparatus is a dual component developer having nonmagnetic toner and magnetic carriers mixed. Negatively charged polyester-family toner having a weight average particle diameter of 7 μm is used as the toner. So-called magnetic powder dispersion resin carriers comprising magnetic powder dispersed in a binding resin or so-called ferrite carriers comprising spherical ferrite particles coated with a resin are used as the carriers. Preferably, the carriers have magnetization in a magnetic field of $10^6/(4\pi)$ A/m ranging from 45 kA/m to 360 kA/m.

In the developing apparatus 4, when a developer is supplied to the developing roll 12, a given amount of the developer is attracted on the peripheral surface of the developing roll 12 based on the magnetic field of the magnetic recording layer 12*b*. That is, almost only one layer of carriers electrically attracting toner is deposited almost equally, forming a developer layer without using layer thickness regulation member. The developer layer is transported to a developing area facing the photosensitive drum 1 as the developing roll 12 rotates, and is made available for developing an electrostatic latent image on the photosensitive drum 1.

<b. Magnetization Method>

Next, a method of magnetizing the magnetic recording layer 12*b* will be discussed.

Figure 5:
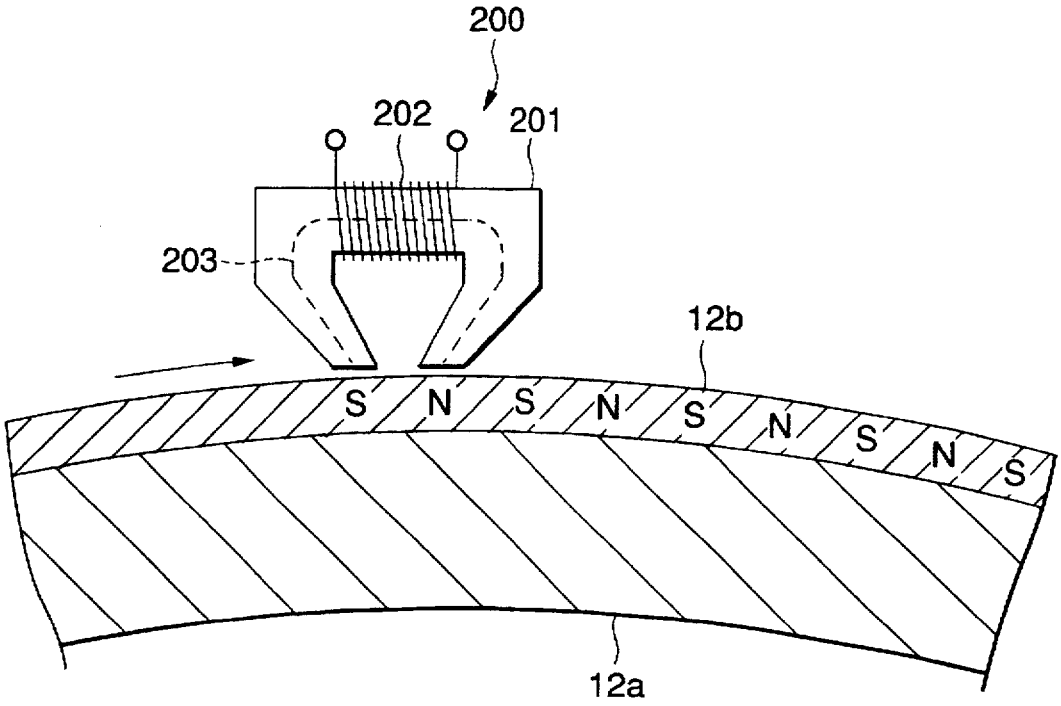
FIG. 5 is an illustration to show a magnetization method of the developing roll shown in FIG. 4.

The magnetic recording layer 12*b* is magnetized by a magnetic recording head 200 placed in the proximity of the peripheral surface of the developing roll 12 as shown in FIG. 5.

The magnetic recording head 200 has a core 201 made of a soft magnetic material and having both ends spaced in parallel and a coil 202 wound around the core 201 and both ends of the core 201 are placed in the proximity of the peripheral surface of the developing roll 12. A magnetization current is supplied from a power supply to the coil 202 via a magnetization signal generator. When the current flows into the coil 202, a magnetic flux occurs in the core 201 and passes through the magnetic recording layer 12*b* from the tip of the core 201, whereby the magnetic recording layer 12*b* is magnetized. The magnetization current supplied to the coil 202 is supplied while it is diverted intermittently or whenever necessary via the magnetization signal generator for magnetizing the peripheral surface of the developing roll 12 rotated as shown in FIG. 5 to a predetermined magnetization pattern. In the embodiment, alternating magnetization of N and S poles is executed in a sine wave pattern in the circumferential direction of the developing roll 12, and the peak value of the magnetic flux density in the radial direction on the developing roll surface is set to 50 mT.

Figure 6:
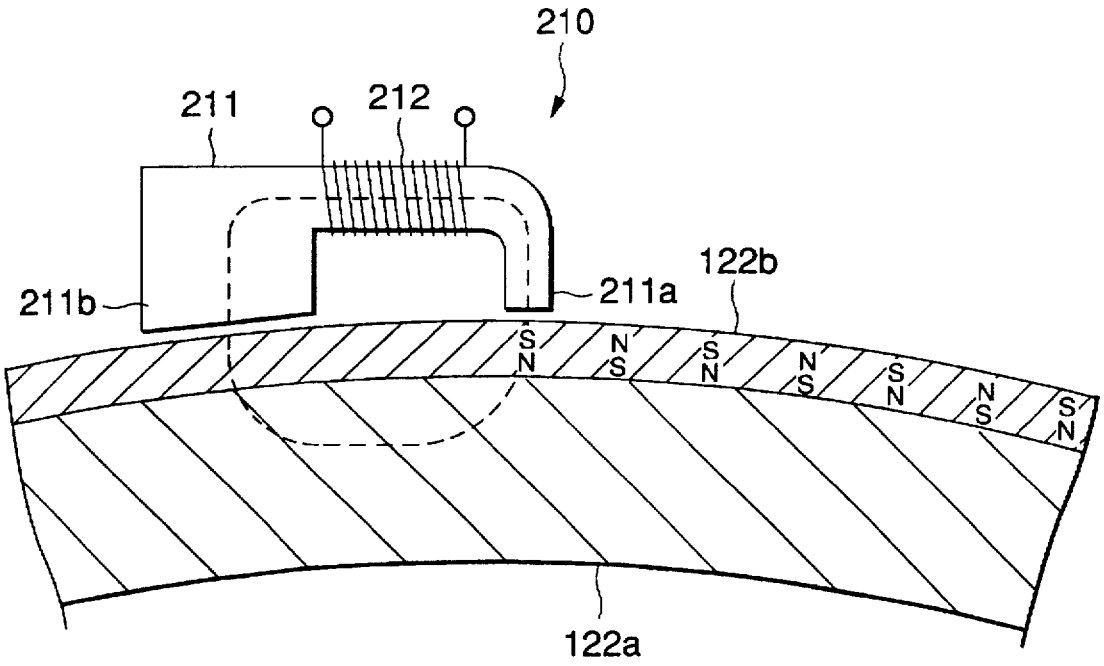
FIG. 6 is an illustration to shown another magnetization method of the developing roll shown in FIG. 4.

A magnetic recording head 201 as shown in FIG. 6 can also be used to magnetize the magnetic recording layer. Use of the magnetic recording head 210 assumes that the developing roll comprises a magnetic recording layer **122*b* placed on a soft magnetic layer 122*a*. Any known soft magnetic material can be used as the soft magnetic layer 122*a***; for example, iron, an iron-silicon alloy, an iron-nickel alloy, or the like is available.

The magnetic recording head 210 has a cross section lessened so that one end **211*a* of a core 211 becomes a small end face, while an opposite end 211*b* has a large end face facing the peripheral surface of the developing roll. When a current is supplied to a coil 212 wound around the core 211, a magnetic flux occurring on the core 211 passes through the magnetic recording layer 122*b* from the small end face and further passes through the soft magnetic layer 122*a* below the magnetic recording layer 122*b*, leading to the opposite end 211*b* of the core 211 having the large end face. Therefore, N and S poles are formed in the thickness direction of the magnetic recording layer 122*b* at the position of the magnetic recording layer 122*b* facing the small end face 211*a* and the portion of the magnetic recording layer 122*b* facing the large end face 211*b* is little magnetized. Such magnetization is executed over almost all area of the peripheral surface of the developing roll, whereby magnetic poles arranged in the thickness direction of the magnetic recording layer 122*b*** can be formed in almost all area of the peripheral surface.

The magnetic recording layer is thus magnetized in the thickness direction thereof, whereby a magnetic field of a large magnetic flux density can be formed; such a magnetization pattern can also be adopted in response to the magnetic pole spacing, used carriers, etc.

<c. Experiment for Examining Relationships Between Magnetic Pole Spacing, etc., and Image Density, Image Uniformity, and Carrier Adhesion>

Next, we will discuss the results of examining the image density, carrier adhesion, and image uniformity by changing the carrier type and particle diameter and the spacing between the magnetic poles of the magnetic recording layer **12*b* in a developing test of electrostatic latent images carried out in the developing apparatus shown in FIG. 3**.

Generally in a developing system using a thin layer of a dual component developer, preferably carriers of small average particle diameter are used to provide fine-grained images. To use carriers of large average particle diameter, the spacing between chains of carriers arranged along a magnetic field becomes wide and coarse, so that it becomes difficult to provide a thin layer high in uniformity. Thus, an image uniformity failure and an edge reproduction failure of a line image will occur. Therefore, preferably the average particle diameter of carriers is 100 μm or less. The test uses carriers of average particle diameters 50 μm and 100 μm. Table 1 lists four types of carriers used.

TABLE 1

| Carrier type | Average particle diameter (μm) | True density ($g/cm^3$) | Magnetization per unit weight ($Am^2/kg$) |
|---|---|---|---|
| (1) | 50 | 2.2 | 40 |
| (2) | 100 | 2.2 | 40 |
| (3) | 50 | 4.5 | 50 |
| (4) | 100 | 4.5 | 50 |

Carrier types (1) and (2) in Table 1 are magnetic powder dispersion resin carrier and (3) and (4) are ferrite carriers. The average particle diameter is a weight average particle diameter. The magnetization per unit weight is a value in a magnetic field of $10^6/(4\pi)$ A/m.

For the mixing ratio between toner and carriers in a developer, the toner weight percentage in the developer is 15% by weight (carriers in (1) or (2)) or 7.9% by weight (carriers in (3) or (4)) so as to set an almost equal toner amount per unit volume. The toner charge amount is adjusted in the range of −15 to −20 mC/kg.

Six developing rolls 12 with magnetic pole spacings 13 μm, 25 μm, 50 μm, 100 μm, 250 μm, and 500 μm on the surface are used.

To evaluate the image density, a solid image is developed and the density thereof is measured with a reflective densitometer (trade name: X-RITE310). If the measurement value is 1.8 or more, both the solid image and line image have a sufficient density; the measurement value 1.8 or more is evaluated as ○ and less the 1.8 as X.

Figure 7:
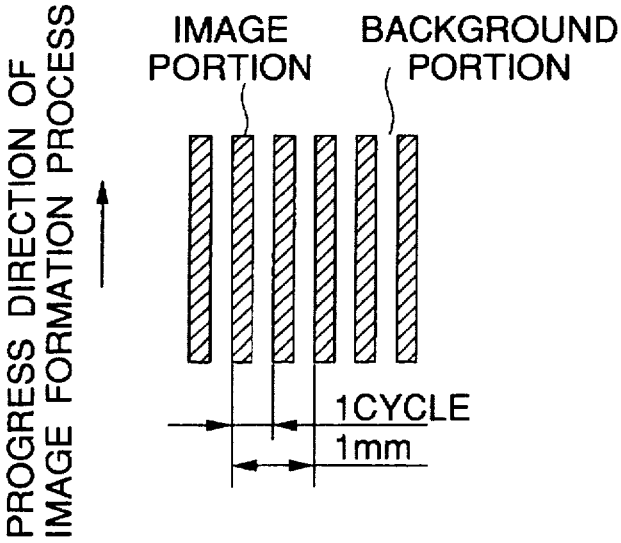
FIG. 7 is an illustration to show an image pattern used to examine the transfer amount of carriers in the dual component developing apparatus to a photosensitive drum in the image formation system shown in FIG. 1.

To evaluate carrier adhesion, so-called alternating lines of image and background portions arranged in parallel at given intervals in a direction at right angles to the progress direction of an image formation process as shown in FIG. 7 are developed and the carrier adhesion amount at this time is measure.

The alternating line intervals are two cycles/mm and the ratio between the image and background portions is 1:1. When such alternating lines are developed, an electrostatic latent image with image and background portions adjacent to each other with a very small spacing exists on the surface of the photosensitive body. Thus, a so-called fringe electric field occurs in the proximity of the surface of the photosensitive layer and an electrostatic suction force acts on the carriers charged to an opposite polarity to the polarity of the toner in the periphery of the image. Therefore, the alternating lines provide an image where carriers easily adhere, and are appropriate for evaluation of carrier adhesion.

The carrier adhesion amount evaluation index uses the area percentage of carrier particles on the background portion of the alternating lines. To measure the area percentage, an image analyzer (trade name: LUZEX-5000) is used. If the area percentage of carrier particles is 1.0% or less, it is a level at which there is no problem on practical use. Therefore, the area percentage 1.0% or less is evaluated as ○ and more than 1.0% as X.

Further, to evaluate image uniformity, each solid image is visually checked and if no density inconsistencies are acknowledge in the visual check, the state is evaluated as ○. A level at which there is no problem on practical use although slight density inconsistencies are acknowledged is set to Δ, and an unavailable level set to X.

Table 2 lists the results of evaluation executed by the method as described above. In the table, the total evaluation ○ means that the three items are evaluated as ○ or Δ, and X means that at least one item is evaluated as X.

TABLE 2

| Carrier type | Magnetic pole spacing | Image density | | Carrier area percentage (%) | | Uniformity | Total evaluation |
|---|---|---|---|---|---|---|---|
| (1) | 13 | 1.51 | X | 5.65 | X | X | X |
| | 25 | 1.93 | ○ | 0.28 | ○ | ○ | ○ |
| | 50 | 1.96 | ○ | 0.11 | ○ | ○ | ○ |
| | 100 | 1.95 | ○ | 0.10 | ○ | ○ | ○ |
| | 250 | 1.84 | ○ | 0.12 | ○ | ○ | ○ |

TABLE 2-continued

| Carrier type | Magnetic pole spacing | Image density | | Carrier area percentage (%) | | Uniformity | Total evaluation |
|---|---|---|---|---|---|---|---|
| | 500 | 0.76 | X | 6.14 | X | X | X |
| (2) | 13 | 1.26 | X | 8.85 | X | X | X |
| | 25 | 1.81 | ○ | 0.68 | ○ | Δ | ○ |
| | 50 | 1.88 | ○ | 0.54 | ○ | ○ | ○ |
| | 100 | 1.96 | ○ | 0.08 | ○ | ○ | ○ |
| | 250 | 1.96 | ○ | 0.12 | ○ | ○ | ○ |
| | 500 | 0.82 | X | 5.52 | X | X | X |
| (3) | 13 | 1.35 | X | 3.32 | X | X | X |
| | 25 | 1.88 | ○ | 0.39 | ○ | ○ | ○ |
| | 50 | 1.96 | ○ | 0.15 | ○ | ○ | ○ |
| | 100 | 1.96 | ○ | 0.10 | ○ | ○ | ○ |
| | 250 | 1.82 | ○ | 0.12 | ○ | ○ | ○ |
| | 500 | 0.78 | X | 4.46 | X | X | X |
| (4) | 13 | 1.19 | X | 6.21 | X | X | X |
| | 25 | 1.82 | ○ | 0.71 | ○ | Δ | ○ |
| | 50 | 1.86 | ○ | 0.34 | ○ | ○ | ○ |
| | 100 | 1.96 | ○ | 0.13 | ○ | ○ | ○ |
| | 250 | 1.96 | ○ | 0.13 | ○ | ○ | ○ |
| | 500 | 0.75 | X | 7.20 | X | X | X |

From Table 2, it is seen that if the magnetic pole spacing ranges from 25 μm to 250 μm, a sufficient image density can be provided without casing a carrier adhesion or uniformity failure.

It the magnetic pole spacing is narrower than 25 μm, it becomes difficult to arrange magnetic carriers along the magnetic field, and the developer layer becomes sparse on the whole. Thus, a sufficient density cannot be provided and image uniformity is not impaired either. The magnetic field in a part distant from the surface of the developing roll 12 rapidly is attenuated and weakens as the magnetic pole spacing becomes narrower. Thus, if the magnetic pole spacing is narrower than 25 μm, the magnetic binding force acting on the magnetic carriers on the developing roll weakens and carrier adhesion occurs due to the fringe electric field effect described above. Further, a phenomenon in which the developer scatters by a centrifugal force acting when the developing roll rotates.

On the other hand, if the magnetic pole spacing is wider than 250 μm, the magnetic binding force acting on the magnetic carriers in the part between the magnetic poles extremely weakens. Thus, the developer adheres concentratedly in the vicinity of the magnetic poles. Therefore, the developer layer is formed with projections and depressions in response to the magnetization pattern and inconsistencies like the magnetization pattern occur on the developed image. Since the magnetic binding force acting on the magnetic carriers adhering to the parts between the magnetic poles is weak as described above, the carriers adhere and the developer scatters.

In contrast, if the magnetic pole spacing ranges from 25 μm to 250 μm, the magnetic carriers are arranged orderly along the magnetic field on the developing roll. Thus, a developer layer of an almost constant thickness not containing any portion where no developer adheres and having no projections or depressions is formed on the developing roll and is held by a magnetic force and is transported.

Therefore, a highly uniform image can be provided without using a layer thickness regulation member. Since the developer transport amount does not depend on parts accuracy, high assembly accuracy is not required. Further, since a strong magnetic binding force acts on the developer layer on the developer support, the carriers do not adhere to the photosensitive body and the developer does not scatter either.

In the developing apparatus shown in FIG. 3, the developer layer on the developing roll 12 is placed out of contact with the photosensitive drum 1. However, a similar effect is produced if the developer layer is brought into contact with the photosensitive drum 1.

In the developing apparatus, the magnetic recording layer **12*b*** comprises a magnetic material dispersed in a binding resin. However, a similar effect is also produced if a magnetic metal material is used. In this case, any known material as a magnet material, magnetic recording material, etc., can be used as the magnetic metal material; for example, Co—Ni—P, Co—Ni, or Co—Cr can be used.

Further, a similar effect is produced if the magnetic recording layer **12*b*** comprises a magnetic material dispersed in a flexible material. In this case, any material into which a large amount of magnetic material can be mixed and which can maintain flexibility can be used as the flexible material; for example, Hypalon, polyisobutylene, neoprene rubber, nitrile rubber, polyetylene chloride, etc., can be used.

Further, in the developing apparatus, the N and S poles are magnetized alternately in the circumferential direction of the developing roll 12. However, a similar effect is produced if the N and S poles are magnetized alternately in the length direction of the developing roll 12.

<d. Experiment for examining relationships between carrier magnetization and magnetic pole spacing and occurrence of density inconsistencies, reproductivity of fine lines, and carrier adhesion>

Next, we will discuss the results of examining carrier adhesion, density inconsistencies in low-density portions, and reproductivity of fine lines by changing carrier magnetization and magnetic pole spacing in the developing apparatus shown in FIG. 3.

In the experiment, ten types of carries listed in Table 3 are used and all are ferrite carriers. The true density is 4.5 g/cm$^3$. The average particle diameter is a weight average particle diameter and the magnetization is values in a magnetic field of $10^6/(4\pi)$ A/m.

TABLE 3

| Carrier type | Average particle diameter (μm) | Magnetization per unit weight (Am$^2$/kg) | Magnetization (kA/m) |
|---|---|---|---|
| (1) | 50 | 5 | 22.5 |
| (2) | 50 | 10 | 45 |
| (3) | 50 | 50 | 225 |
| (4) | 50 | 80 | 360 |
| (5) | 50 | 100 | 450 |
| (6) | 100 | 5 | 22.5 |
| (7) | 100 | 10 | 45 |
| (8) | 100 | 50 | 225 |
| (9) | 100 | 80 | 360 |
| (10) | 100 | 100 | 450 |

For the mixing ratio between toner and carriers in a developer, the toner weight percentage in the developer is 7.9% by weight. The toner charge amount is adjusted in the range of −15 to −20 mC/kg.

Two developing rolls with magnetic pole spacings 25 μm and 250 μm on the surface are used.

In the experiment, images are formed under the above-mentioned conditions and the output images are evaluated as follows:

For image uniformity in low-density portions, each dot image with area percentage 20% is visually checked and if no minute density inconsistencies are acknowledged in the visual check, the state is evaluated as ○. A level at which there is no problem on practical use although slight minute density inconsistencies are acknowledged is set to Δ, and an unavailable level set to X.

For reproductivity of fine lines, each line image 130 μm wide is visually checked and if neither edge burrs nor density inconsistencies are acknowledged in the visual check, the state is evaluated as ○. A level at which there is no problem on practical use although slight burrs and density inconsistencies are acknowledged is set to Δ, and an unavailable level set to X.

Carrier adhesion is evaluated by a similar method to that in the previous experiment.

Table 4 lists the experiment results. In the table, the total evaluation ○ means that the four items are evaluated all as ○, Δ means that the four items are evaluated as ○ or Δ, and X means that at least one item is evaluated as X.

From the results listed in Table 4, it is seen that if the carrier magnetization ranges from 45 kA/m to 360 kA/m, a sufficient image density can be provided without causing carrier adhesion and at the same time, uniformity in low-density portions and reproductivity of fine lines become good.

As the magnetic pole spacing on the developer support becomes wider, the developer layer is easily formed with projections and depressions in response to a magnetization pattern. However, occurrence of such projections and depressions on the developer support can be suppressed by setting the carrier magnetization to 360 kA/m or less for weakening the magnetic binding force acting on the carriers. Therefore, the uniformity in low-density portions and the reproductivity of fine lines can be enhanced On the other hand, if the carrier magnetization is greater than 360 kA/m, the projections and depression become remarkable; the uniformity in low-density portions and the reproductivity of fine lines lower although they are not a level at which the developing apparatus becomes difficult to use on practical application.

For the reasons, when the magnetic pole spacing is in the range of 25 μm to 250 μm, the carrier magnetization in a magnetic field of $10^6/(4\pi)$ A/m is placed in the range of 45 kA/m to 360 kA/m, whereby a sufficient image density can be provided without causing carrier adhesion and at the same time, the uniformity in low-density portions and the reproductivity of fine lines can be enhanced.

TABLE 4

| Magnetic pole spacing (μm) | Carrier type | Image density | | Carrier area percentage (%) | | Uniformity in low-density portion | Reproductivity of fine lines | Total evaluation |
|---|---|---|---|---|---|---|---|---|
| 25 | (1) | 1.87 | ○ | 0.64 | ○ | Δ | Δ | Δ |
| | (2) | 1.88 | ○ | 0.41 | ○ | ○ | ○ | ○ |
| | (3 | 1.88 | ○ | 0.39 | ○ | ○ | ○ | ○ |
| | (4) | 1.90 | ○ | 0.25 | ○ | ○ | ○ | ○ |
| | (5) | 1.91 | ○ | 0.21 | ○ | ○ | ○ | ○ |
| | (6) | 1.80 | ○ | 0.93 | ○ | Δ | Δ | Δ |
| | (7) | 1.80 | ○ | 0.82 | ○ | ○ | ○ | ○ |
| | (8) | 1.82 | ○ | 0.71 | ○ | ○ | ○ | ○ |
| | (9) | 1.82 | ○ | 0.73 | ○ | ○ | ○ | ○ |
| | (10) | 1.82 | ○ | 0.80 | ○ | ○ | ○ | ○ |
| 250 | (1) | 1.81 | ○ | 0.38 | ○ | ○ | ○ | ○ |
| | (2) | 1.82 | ○ | 0.23 | ○ | ○ | ○ | ○ |
| | (3) | 1.82 | ○ | 0.12 | ○ | ○ | ○ | ○ |
| | (4) | 1.84 | ○ | 0.12 | ○ | ○ | ○ | ○ |
| | (5) | 1.84 | ○ | 0.12 | ○ | Δ | Δ | Δ |
| | (6) | 1.90 | ○ | 0.20 | ○ | ○ | ○ | ○ |
| | (7) | 1.92 | ○ | 0.14 | ○ | ○ | ○ | ○ |
| | (8) | 1.96 | ○ | 0.13 | ○ | ○ | ○ | ○ |
| | (9) | 1.96 | ○ | 0.11 | ○ | ○ | ○ | ○ |
| | (10) | 1.96 | ○ | 0.11 | ○ | Δ | Δ | Δ |

The reasons why the carrier magnetization affects the uniformity in low-density portions and the reproductivity of fine lines can be thought as follows:

As described above, the magnetic field at a portion distant from the surface of the developing roll 12 rapidly is attenuated and weakens as the magnetic pole spacing becomes narrower. Therefore, as the magnetic pole spacing becomes narrower, a void, namely, a portion where not developer adheres occurs easily on the developer layer.

Occurrence of such voids on the developer layer can be suppressed by setting the carrier magnetization to 45 kA/m or more for strengthening the magnetic binding force acting on the carriers. Therefore, the uniformity in low-density portions and the reproductivity of fine lines can be enhanced.

On the other hand, if the carrier magnetization is smaller than 45 kA/m, it becomes difficult to make carriers uniformly adhere onto the surface of the developing roll without producing so-called developer voids. The uniformity in low-density portions and the reproductivity of fine lines lower although they are not a level at which the developing apparatus becomes difficult to use on practical application.

In the experiment, ferrite carriers are used. However, if the magnetization is in the above-mentioned range, a similar effect is also produced when so-called magnetic powder dispersion resin carriers comprising magnetic powder dispersed in a binding resin are used.

<e. Experiment for maintainablity>

Next, an experiment carried out on maintainability of the developing apparatus shown in FIG. 3 will be discussed.

In the experiment, the image formation system shown in FIG. 1 is used to consecutively develop 100,000 sheets of solid images by the developing apparatus shown in FIG. 3. After a predetermined number of sheets are developed, the solid image developing density and the toner charge amount are measured for examining the statistics as the cumulative number of development sheets increases.

To examine the effect of the developing apparatus according to the invention, a conventional developing apparatus is used to perform similar developing and the results are compared with those produced by the developing apparatus shown in FIG. 3.

In the experiment, the following developer is used:

Carriers: Ferrite carriers

Average particle diameter: 50 μm

True density: 4.5 g/cm$^3$

Magnetization per unit weight: 50 A•m$^2$/kg

Toner: Negatively charged polyester-family toner

Average particle diameter: 7 μm

Charge amount: −15 to −20 mC/kg

The magnetic pole spacing on the developing roll surface is 100 μm.

Figure 8:
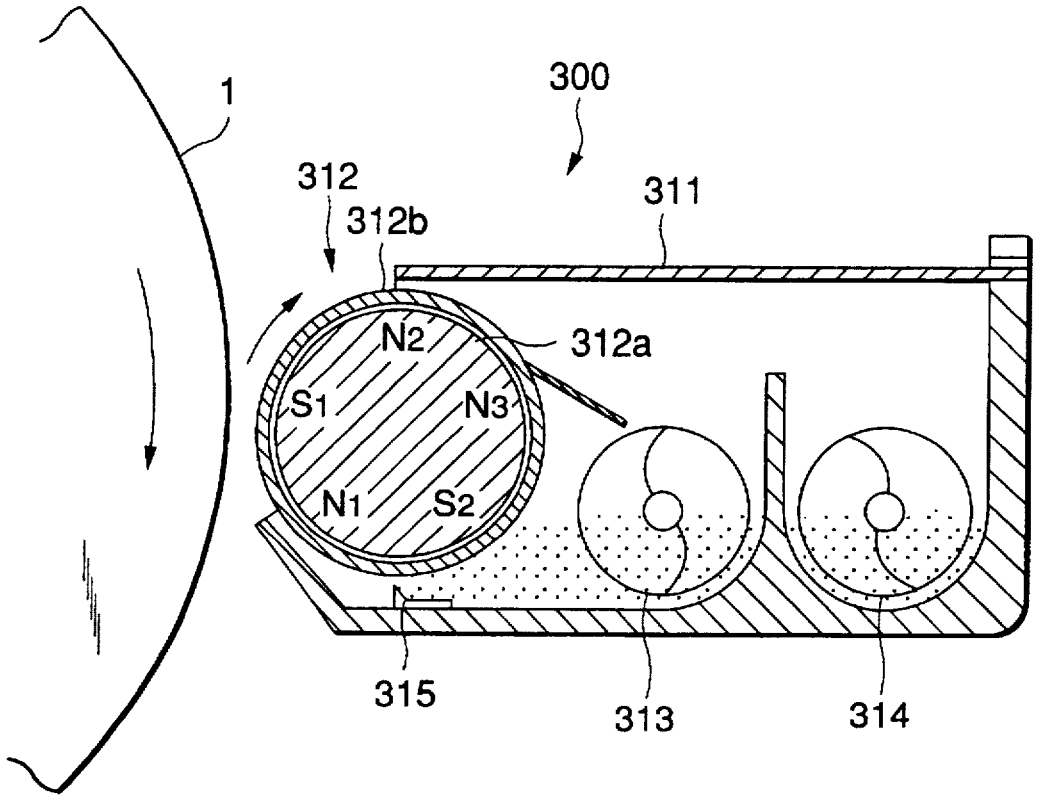
FIG. 8 is a schematic diagram to show the configuration of a conventional developing apparatus used for performance comparison with the developing apparatus shown in FIG. 3.

On the other hand, the conventional developing apparatus 300 used for comparison has a layer thickness regulation member 315 disposed in the proximity of and facing a developing roll 312, as shown in FIG. 8. The developing roll 312 has a magnet roll 312*a* fixedly supported and a sleeve 312*b* rotated round the periphery of the magnet roll. The magnet roll 312*a* is formed with five magnetic poles in the circumferential direction. A magnetic field produced by the magnetic poles causes the developer to be attracted on the surface of the sleeve 321*b* and move with rotation of the sleeve 312*b*. The developer amount is regulated at a position opposite to the layer thickness regulation member 315, forming a thin layer of the developer.

The dimensions and setting of the main parts of the developing apparatus are as follows:

Developing roll: 18 mm in outer diameter

Peripheral speed of developing roll: 320 mm/s

Developing area setting:

Spacing between photosensitive drum and developing roll: 500 μm

Position at which photosensitive drum and developing roll become the closest to each other: Almost middle point of magnetic poles N1 and S1

Center angle of positions of magnetic poles N1 and S1: 70°

Magnetic flux density at position of magnetic pole N1, S1: 70 mT

Developing bias: AC voltage on which DC voltage is superposed

DC component: −400 V

AC component: 6-kHz rectangular wave, peak-to-peak voltage 1.6 KV

Each of the two developing apparatuses stores a 400-gram developer in a housing and is replenished with toner whenever necessary so that the toner weight percentage in the developer becomes 7.5%–8.5% by weight.

Figure 9:
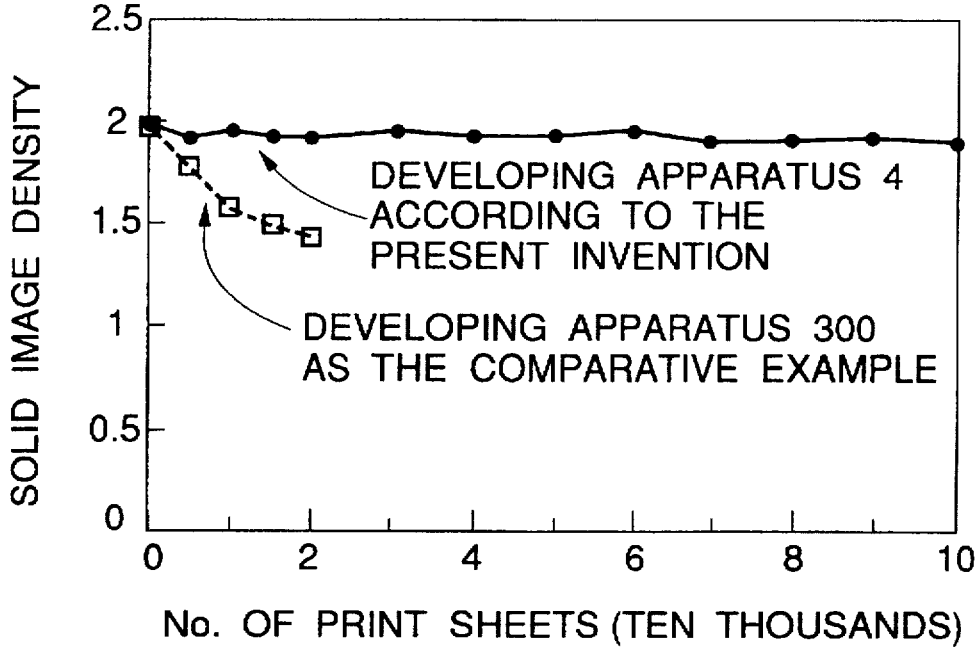
FIG. 9 is a graph to show the relationship between the number of print sheets and the solid image density in the developing apparatuses shown in FIGS. 3 and 8.
Figure 10:
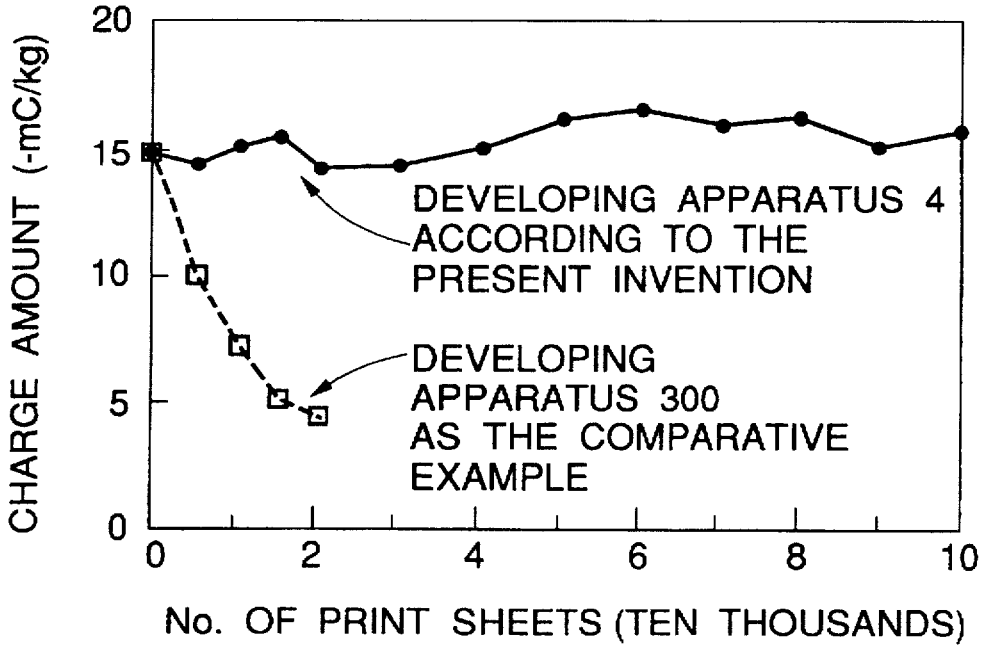
FIG. 10 is a graph to show the relationship between the number of print sheets and the toner charge amount in the developing apparatuses shown in FIGS. 3 and 8.

FIGS. 9 and 10 show the solid image density and toner charge amount statistics when the developing apparatus according to the invention (FIG. 3) and the conventional developing apparatus (FIG. 8) are used each to develop 100,000 sheets.

As seen in the figures, the developing apparatus 4 according to the invention maintains the image density and toner charge amount good throughout the developing of 100,000 sheets. On the other hand, the density and toner charge amount lower abruptly in the conventional developing apparatus 300 of a comparative example. As the toner charge amount lowers, background fog is caused by toner scattering at developing of 20,000 sheets and the developer reaches the end of the life.

As the result of examining the state of the developer after the long-term developing experiment, remarkable toner degradation and carrier degradation were observed in the developer used with the conventional developing apparatus 300. Since a strong stress acts on the developer when the layer thickness of the developer is regulated by the layer thickness regulation member 315 in the conventional developing apparatus 300, toner degradation and carrier degradation occur at an early stage. This effect causes the density and toner charge amount to lower as described above.

On the other hand, since the developing apparatus 4 according to the invention uses no layer thickness regulation member, no stress acts on the developer when a developer layer is formed. Therefore, degradation of the developer can be prevented. In the developer used with the developing apparatus 4, the toner and carriers after being subjected to the long-term developing experiment are in a similar state to the initial state and no degradation condition is observed. The developer transport amount little changes throughout developing of 10,000 sheets.

Thus, the developing apparatus of the invention can stably maintain good image quality over a long term.

[3. Second embodiment]

Figure 11A:
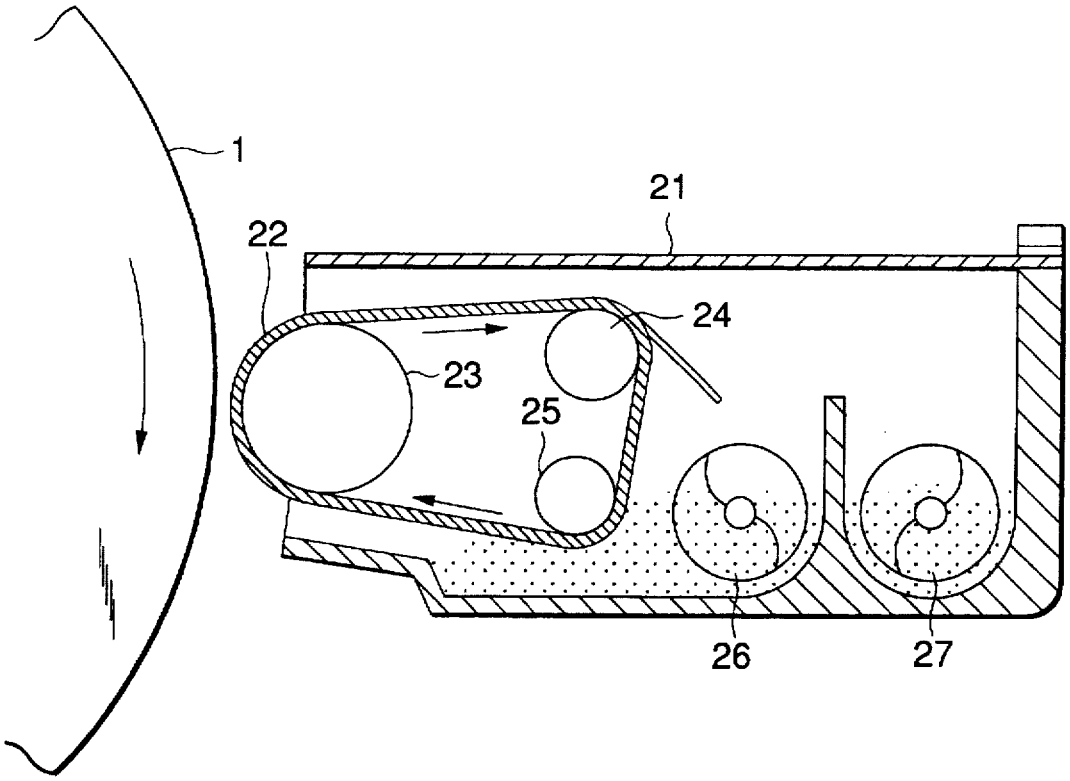
FIGS. 11A–11B are schematic diagrams to show the configuration of a developing apparatus of a second embodiment of the invention and a partially enlarged sectional view of a developer support used with the developing apparatus.
Figure 11B:
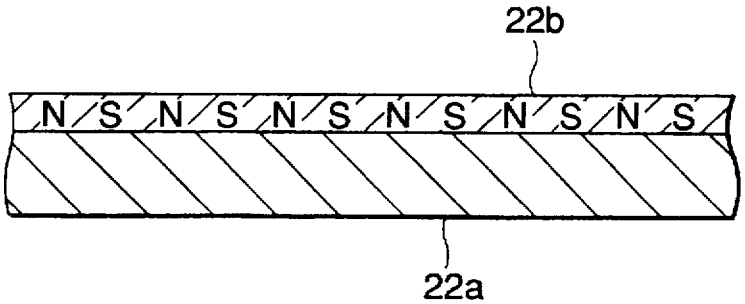

FIG. 11 is a schematic diagram to show the configuration of a developing apparatus of a second embodiment of the invention and a partially enlarged sectional view of a developer support.

The developing apparatus is formed with a developing opening in a part of a developing housing 21 for housing a developer opposite to a photosensitive drum 1 and has a developer support 22 disposed in the opening. It also has a developer agitation and transport chamber at the rear of the developer support 22, in which two screw augers 26 and 27 are disposed.

The developer support 22, which is an endless belt 22 placed on a drive roll 23 and two support rolls 24 and 25, is turned in the direction of the arrow shown in the figure by rotation of the drive roll 23. The drive roll 23 is 10 mm in outer diameter and is rotated so that the belt 22 moves at a peripheral speed of 320 mm/s.

The belt 22 comprises a magnetic recording layer 22*b* laminated on a conductive substrate 22*a*. A developing bias voltage is applied to the conductive substrate 22*a* from a developing bias power supply (not shown). It is an AC voltage on which a DC voltage is superposed, and has a DC component set to −400 V to prevent background fog from occurring and an AC component which is a rectangular wave of frequency 6 kHz and peak-to-peak voltage 1.5 kV. The magnetic recording layer 22*b* is magnetized with an alternating pattern of S and N poles spaced equally apart on all the periphery of the belt 22. The magnetic recording layer 22*b* uses $\gamma$-$Fe_2O_3$ as a magnetic material and polyurethane as a binding resin; it is 50 μm thick.

A magnetic recording head as shown in FIG. 5 is used to magnetize the magnetic recording layer 22*b* in a sine pattern of an alternating pattern of N and S poles in the circumferential direction of the belt 22. The magnetization direction is set so as to produce the N and S poles in a horizontal direction. The magnetic poles are spaced 100 μm apart on the surface of the belt 22 and the peak value of the magnetic flux density in a vertical direction is 50 mT.

In the developing apparatus, when a developer is supplied to the belt 22, a given amount of the developer is deposited on the belt 22 based on the magnetic field of the magnetic recording layer 22*b* for forming a thin layer of the developer without using a layer thickness regulation member. Further, the developer is transported to a developing area facing the photosensitive drum 1 as the belt 22 turns, and is made available for developing an electrostatic latent image on the photosensitive drum 1.

At this time, almost one layer of carriers attracting toner is deposited almost equally on the peripheral surface of the belt and the gap between the belt and the photosensitive drum is set to 300 μm, thus the developer layer is held out of contact with the photosensitive drum.

In such a developing process, the carriers are held on the magnetic poles of the belt and the developer does not scatter. Also, a uniform thin layer of the developer is supplied to the developing area, thus providing a uniform image of high quality.

A long-term developing experiment of 100,000 sheets was carried out with the developing apparatus as with the developing apparatus shown in FIG. 3. The image density and toner charge amount were maintained good throughout the 100,000 sheets, and a degradation condition was not observed in the developer after the experiment.

An endless belt is used as the developer support as in the developing apparatus, whereby high design flexibility can be provided as compared with the cylindrical form of the developer support. For example, as in the developing apparatus, the drive roll can be made small in diameter as compared with the cylindrical developer support and the developing opening of the housing can be designed narrow. Therefore, the developing apparatus and the whole image formation system can be downsized. The routing form of the developer support (belt) in parts other than the developing part can also be designed as desired and can be easily adapted to the optimum conditions in each part.

[4. Third embodiment]

Figure 12A:
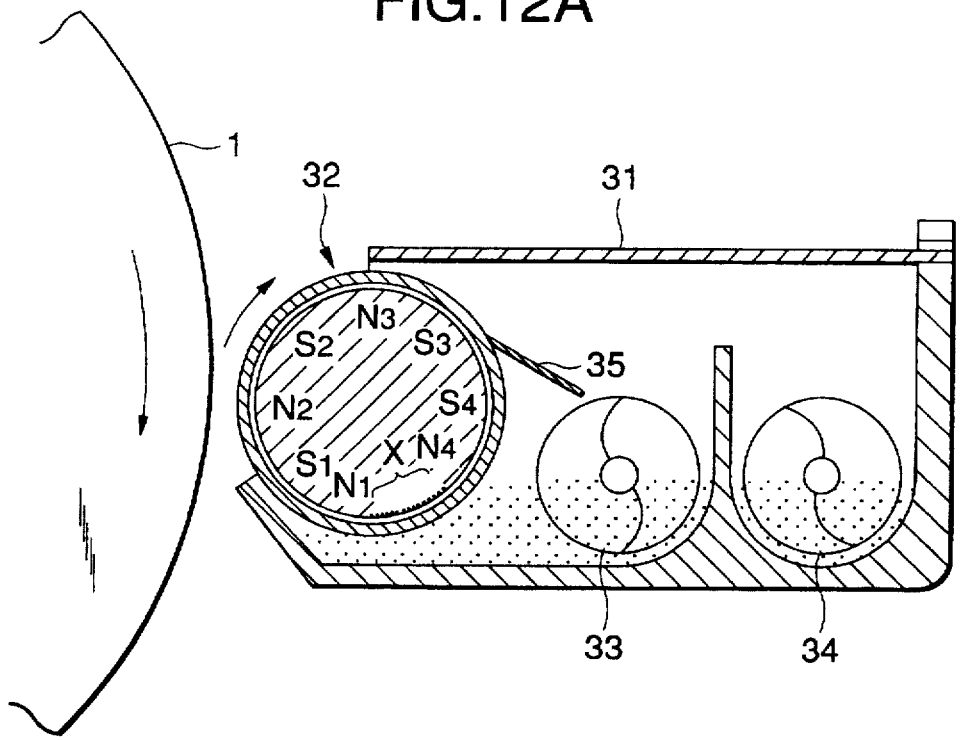
FIGS. 12A–B are schematic diagrams to show the configuration of a developing apparatus of a third embodiment of the invention and a partially enlarged sectional view of a developing roll used with the developing apparatus.
Figure 12B:
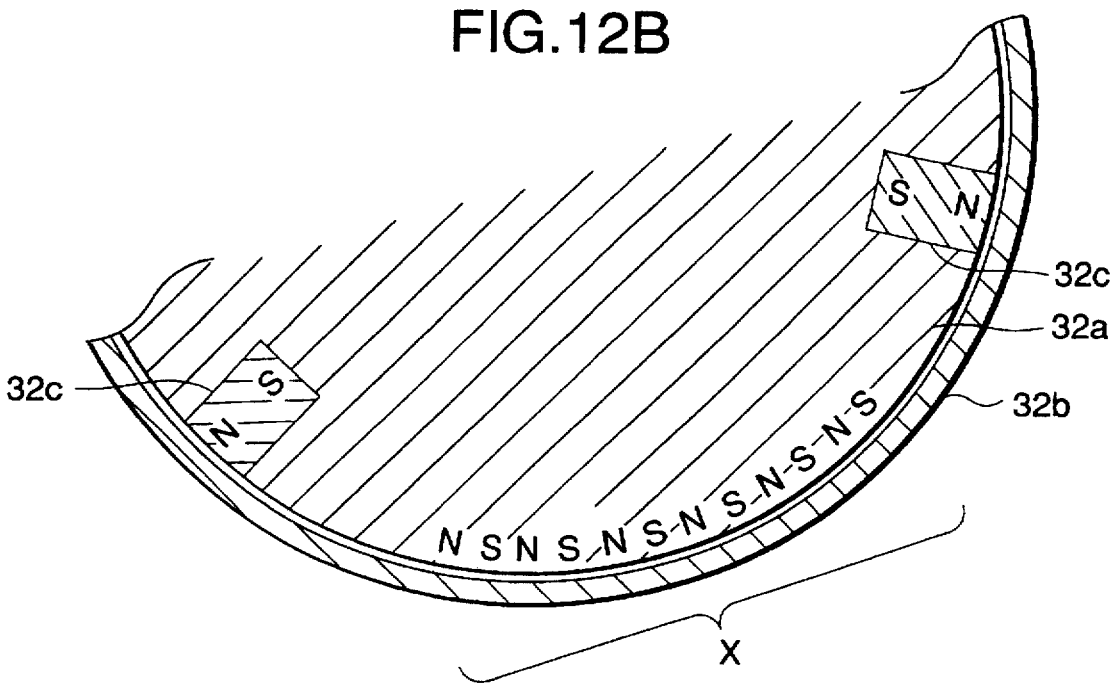

FIG. 12 is a schematic sectional view to show a developing apparatus of a third embodiment of the invention and a partially enlarged sectional view of a developing roll used with the developing apparatus.

Like the developing apparatus 3, the developing apparatus of the third embodiment has a developing roll 32, two screw augers 33 and 34, and a scraper 35 in a housing 31; the developing roll 32 used with the developing apparatus has a main section consisting of a magnet roll 32*a* fixedly supported so as to prevent rotation and a cylindrical sleeve 32*b* rotated outside the magnet roll 32*a*.

The position of the magnet roll 32*a* corresponding to a layer formation portion, namely, portion X where a developer is attracted on the surface of the sleeve 32*b* for forming a thin layer is magnetized so that S and N poles are alternately spaced equally apart in the circumferential direction (magnetic pole spacing on the sleeve, 250 μm). Eight magnetic poles N1, S1, N2, S2, N3, S3, S4, and N4 are disposed in the portion other than the area X and the center angle between the adjacent magnetic poles is 35°.

The magnetic poles in the area X are formed by making a magnetic recording layer on a substrate for forming the magnet roll and magnetizing the magnetic recording layer. The magnetic flux density of the magnetic poles in the radial direction on the surface of the sleeve is set to 50 mT (peak value). On the other hand, the magnetic poles N1, S1, N2, S2, N3, S3, S4, and N4 are formed by embedding magnetized ferrite magnets 32*c*. The magnetic flux density of the magnetic poles S1–S4 and N1–N4 in the radial direction is set to 60 mT on the peripheral surface of the sleeve 32*b*. The position at which a photosensitive drum and the sleeve become the closest to each other is placed in an almost middle point of magnetic poles S1 and N2.

The sleeve 32*b* is set to 18 mm in outer diameter and 320 mm/s as travel speed of the peripheral surface and faces the photosensitive drum with a 500-μm gap therebetween. An AC voltage on which a DC voltage is superposed is applied to the sleeve 32*b* as a developing bias voltage. It has a DC component set to −400 V and an AC component which is a rectangular wave of frequency 6 kHz and peak-to-peak voltage 1.6 kV.

In the developing apparatus, when a developer is supplied to the sleeve 32*b* by the screw auger 33, a given amount of the developer is deposited on the sleeve 32*b* by the action of the magnetic poles in the area X for forming a thin layer of the developer without using a layer thickness regulation member. The developer layer is transported as the sleeve 32*b* rotates. When the developer layer exceeds the area X, it is held on the sleeve 32*b* by the magnetic field of the spaced magnetic poles N1, S1, N2, . . . . The developing roll 32 is transported to a developing area facing the photosensitive drum 1 and toner in the developer held on the sleeve 32*b* is transferred onto the photosensitive drum 1 for developing an electrostatic latent image thereon. At this time, the thickness of the developer layer is set so that it becomes 200 μm at the middle point of the magnetic poles S1 and N2, and the developer layer is placed out of contact with the photosensitive drum 1 for developing the electrostatic latent image. The developer passing through the developing area is stripped off from the sleeve 32*b* by the scraper 35 and the action of a repulsive magnetic field produced by the two magnetic poles of the same polarity, S3 and S4, drops into the developer agitation and transport chamber, and is mixed with new toner supplied from a toner replenishing device (not shown) for supply to the next use.

Since almost one layer of carriers attracting toner is deposited almost equally on the sleeve 32*b* by the magnetic field formed in the area X and is also held in other portions by the magnetic poles N1–N4 and S1–S4, a highly uniform image of high quality can be provided without causing carrier adhesion or developer scattering.

Further, the internal member is fixedly supported and is formed with magnetic poles as in the developing apparatus, whereby the magnetic pole spacing in the area X is set to about 25–250 μm for forming a uniformly thin developer film on the sleeve and the developing and transport magnetic poles in areas other than the layer formation portion can adopt any desired magnetic pole pattern. Therefore, an optimum magnetic pole pattern can be adopted in response to requirements of the image quality, process speed, etc.

A long-term developing apparatus of 100,000 sheets was carried out with the developing apparatus as with the developing apparatus shown in FIG. 3. The image density and toner charge amount were maintained good throughout the 100,000 sheets, and a degradation condition was not observed in the developer after the experiment.

In the developing apparatus, the developer layer on the sleeve 32*b* is placed out of contact with the photosensitive drum 1. However, a similar effect is produced if the developer layer is brought into contact with the photosensitive drum 1.

The magnetic pole spacing on the sleeve surface in the area X of the developing roll is set to 250 μm. However, a similar effect is produced if the magnetic pole spacing is set in the range of 25 μm to 250 μm.

In the developing apparatuses shown in FIGS. 3, 11, and 12 discussed above, the configurations of the developing rolls, the endless belts, and the magnetic rolls used as the developer supports are not limited to those of the embodiments and any desired configurations can be adopted in response to the purpose and application. For example, a conductive layer, resistance layer, protective layer, abrasion resistance layer, etc., may be formed on the magnetic recording layer.

Also, a bonding layer, underlying layer, non-magnetic layer, elastic layer may be formed between the conductive and magnetic recording layers, between the soft magnetic and magnetic recording layers, or between the substrate and magnetic recording layers.

[5. Fourth embodiment]

<a. Configuration and operation of developing apparatus>

FIG. 13 is a schematic diagram to show the configuration of a developing apparatus of a fourth embodiment of the invention and a partially enlarged sectional view of a developing roll used with the developing apparatus.

Figure 13A:
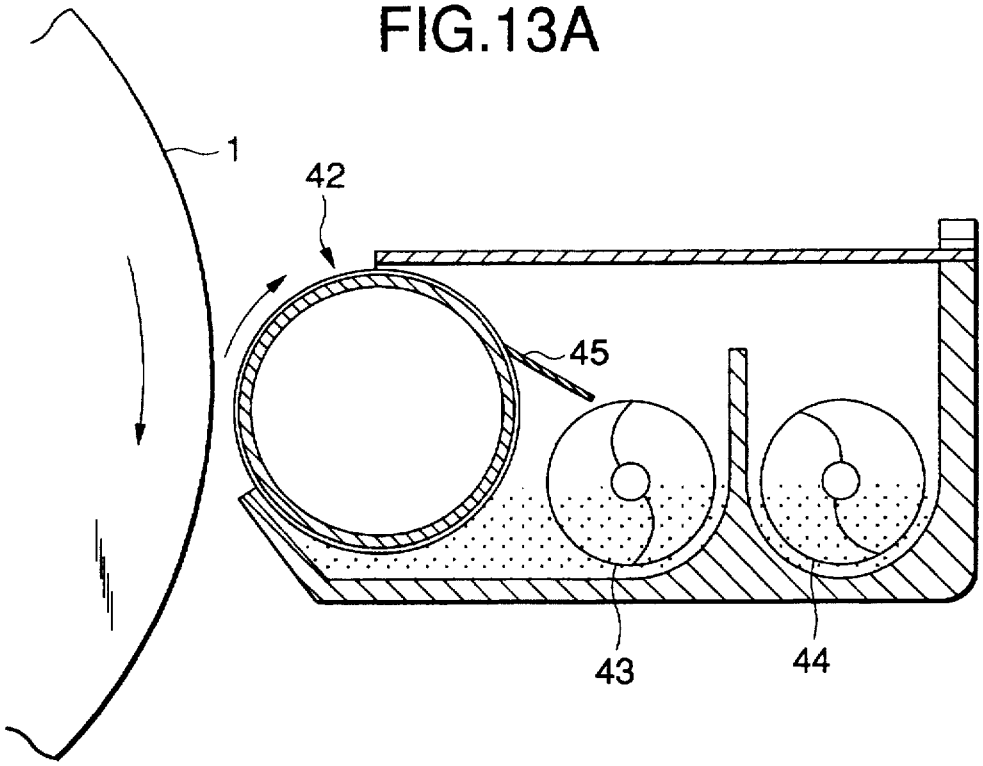
FIGS. 13A–B are schematic diagrams to show the configuration of a developing apparatus of a fourth embodiment of the invention and a partially enlarged sectional view of a developing roll used with the developing apparatus.

As shown in FIG. 13A, this developing apparatus has a developing roll 42 placed in the proximity of and facing a photosensitive drum 1, two screw augers 43 and 44 at the rear of the developing roll 42, and a scraper 45 placed so that is tip comes in contact with the developing roll 42.

Figure 13B:
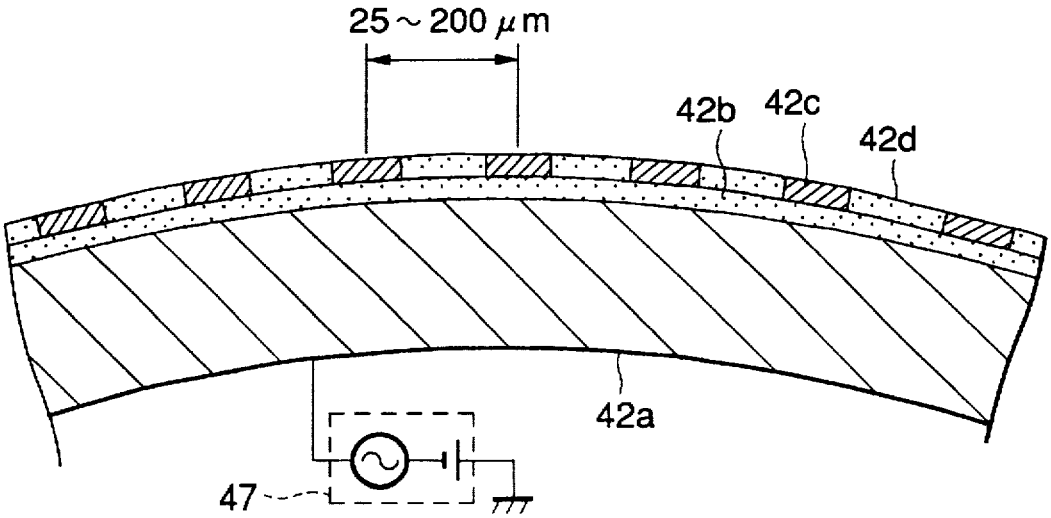
Figure 14:
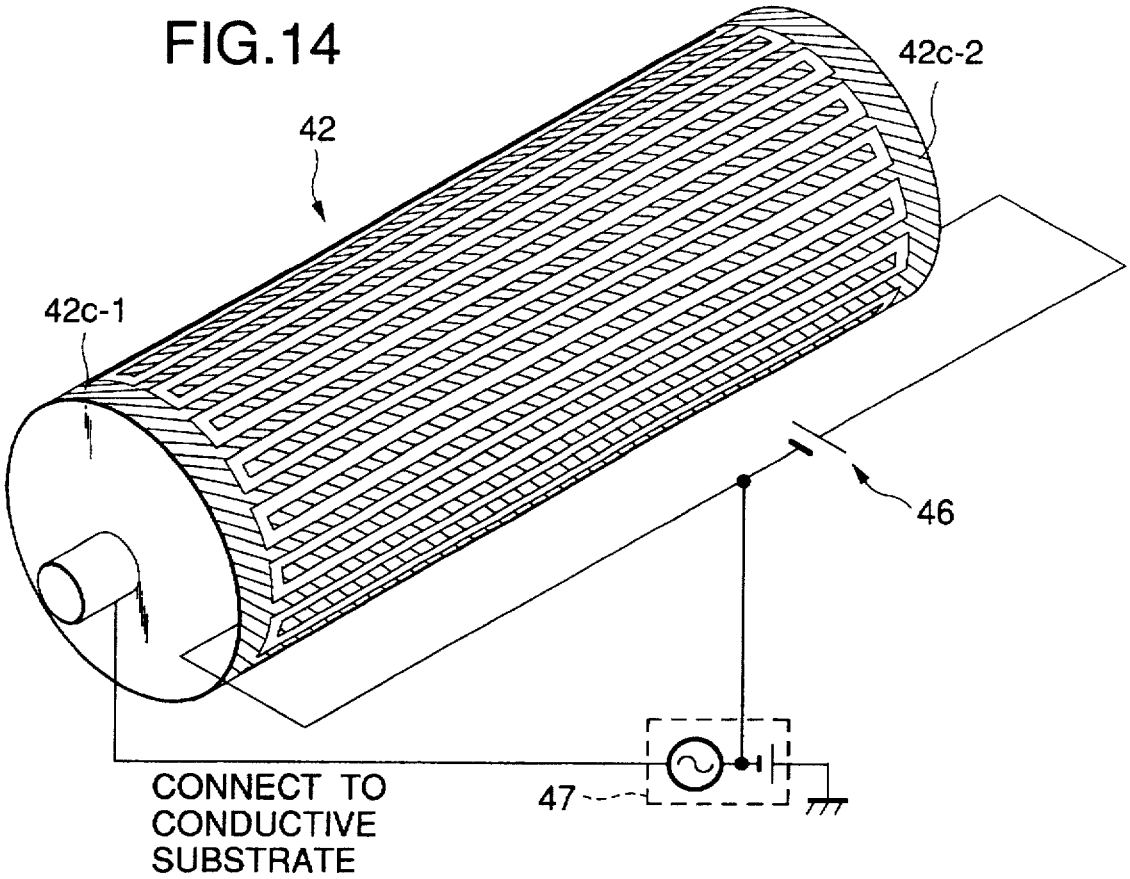
FIG. 14 is a schematic perspective view of the developing roll used with the developing apparatus shown in FIG. 13.

As shown in FIG. 13B, the developing roll 42 has a conductive substrate 42*a*, an insulative layer 42*b* on the conductive substrate 42*a*, and elongated electrodes 42*c* covering almost the entire axial length of the developing roll, the electrodes 42*c* being laminated on the insulative layer 42*b*. As shown in FIG. 14, the electrodes are connected every other electrode at both ends of the developing roll and form projections like a comb from both sides. An insulating material layer 42*d* is formed between the electrodes, so that the developing roll is finished as a smooth surface.

A developing bias voltage is applied to the conductive substrate 42*a* of the developing roll 42 from a developing bias power supply 47. If is an AC voltage on which a DC voltage is superposed, and has a DC component set to −400 V and an AC component which is a rectangular wave of frequency 6 kHz and peak-to-peak voltage 1.5 kV. The DC component of the developing bias voltage is applied to one electrode group 42*c*-1 projecting like a comb from the end of the developing roll. A voltage comprising DC voltage superposed on the DC component of the developing bias voltage by a DC power supply 46 is applied to an opposite comb electrode group 42*c*-2 on the peripheral surface of the developing roll. Thus, an electric field is generated between the adjacent electrodes on the developing roll 42. The voltage of the DC power supply 46 is set so as to generate a 1-V potential difference per μm as the electric field generated between the adjacent electrodes. That is, in the developing apparatus discussed here, both the width of each elongated electrode and the gap between the electrodes are set to 100 μm and the potential difference between the adjacent electrodes is set to 100 V.

The dual component developer used with the developing apparatus uses negatively charged polyester-family toner having a weight average particle diameter of 7 μm as toner and so-called ferrite carriers comprising spherical ferrite particles (average particle diameter 50 μm) coated with a resin used as carriers.

The developing apparatus is the same as the developing apparatus shown in FIG. 3 in other components.

In the developing apparatus, when a developer is supplied to a space near the developing roll 42, the electric field between the electrodes 42*c* causes inductive charges to occur in carriers, polarizing the carriers. The carriers are attracted on the peripheral surface of the developing roll 42 by the action of the electric field, forming a developer layer. At this time, the electrode spacing is too small to 100 μm, about twice the particle diameter of the carrier, thus the electric force line passes through the inside of the carrier attracted on the peripheral surface of the developing roll 42 and little finds its way into the outside. Thus, multiple layers of the carriers cannot be deposited on the peripheral surface of the developing roll 42, and a thin developing layer is formed almost uniformly.

Such a developer layer is transported to a developing area opposite to the photosensitive drum 1 by rotation of the developing roll 42. In the developing area, an electric field is formed between the developing roll 42 and the photosensitive drum 1 and the gap therebetween is set to 300 μm. The developer layer formed as described above is placed out of contact with the photosensitive drum 1 in the developing area and the toner adhering to the carriers is transferred to the photosensitive drum 1 by the action of the electric field for developing an image.

Thus, the developer layer is thinned and the gap between the photosensitive drum 1 and the developing roll 42 is set small, whereby high-resolution developing can be executed at high speed. Since a thin developer layer is formed without using a layer thickness regulation member, degradation of the developer can be suppressed and developing of high picture quality can be executed over a long term.

<b. Experiment for examining relationships between the electrodes spacing or applied voltage and image density, image uniformity, and carrier adhesion>

Next, we will discuss an experiment of examining the relationships with the image density, carrier adhesion, and image uniformity by changing the spacing between the electrodes of the developing roll used with the developing apparatus or voltages applied between the adjacent electrodes.

In the experiment, for the hold voltage applied between the adjacent electrodes, the voltage producing a 1-V potential difference per μm between the adjacent electrodes is used as a reference voltage and the hold voltage is set so as to become 50%, 80%, 100%, 120%, 150% of the reference hold voltage. Six developing rolls with electrode spacing 15 μm, 15 μm, 50 μm, 100 μm, 200 μm, and 300 μm on the surface of the developing roll are used. In the developing rolls, the electrodes are formed so that the ratio between the electrode width and electrode spacing is set to 50:50.

For the mixing ratio between toner and carriers in a developer, the toner weight percentage in the developer is 7.9% by weight. The toner charge amount is adjusted in the range of −10 to −20 mC/kg.

The experiment method and evaluation method are the same as those for the experiment carried out for examining the image density, carrier adhesion, and image uniformity about the developing apparatus shown in FIG. 3.

TABLE 5

| Electrode spacing (μm) | Hold voltage (V) | Image density | | Carrier area percentage (%) | | Uniformity | Total evaluation |
|---|---|---|---|---|---|---|---|
| 15 | 7.5 | 1.87 | ○ | 4.26 | X | X | X |
| | 12 | 1.82 | ○ | 2.54 | X | X | X |
| | 15 | 1.5 | X | 0.25 | ○ | X | X |
| | 18 | 0.86 | X | 0.18 | ○ | X | X |
| | 22.5 | 0.58 | X | 0.15 | ○ | X | X |
| 25 | 12.5 | 1.95 | ○ | 5.85 | X | X | X |
| | 20 | 1.92 | ○ | 0.56 | ○ | Δ | ○ |
| | 25 | 1.95 | ○ | 0.25 | ○ | ○ | ○ |
| | 30 | 1.88 | ○ | 0.21 | ○ | ○ | ○ |
| | 37.5 | 1.15 | X | 0.12 | ○ | ○ | ○ |
| 50 | 25 | 1.97 | ○ | 4.71 | X | X | X |
| | 40 | 1.98 | ○ | 0.48 | ○ | Δ | ○ |
| | 50 | 1.92 | ○ | 0.21 | ○ | ○ | ○ |
| | 60 | 1.84 | ○ | 0.16 | ○ | ○ | ○ |
| | 100 | 1.21 | X | 0.14 | ○ | ○ | ○ |
| 100 | 50 | 1.98 | ○ | 6.11 | X | X | X |
| | 80 | 1.96 | ○ | 0.55 | ○ | Δ | ○ |
| | 100 | 1.94 | ○ | 0.26 | ○ | ○ | ○ |
| | 120 | 1.68 | ○ | 0.18 | ○ | ○ | ○ |
| | 150 | 1.28 | X | 0.11 | ○ | ○ | X |
| 200 | 100 | 1.96 | ○ | 8.52 | X | X | X |
| | 160 | 1.98 | ○ | 0.38 | ○ | ○ | ○ |

TABLE 5-continued

| Electrode spacing (μm) | Hold voltage (V) | Image density | | Carrier area percentage (%) | | Uniformity | Total evaluation |
|---|---|---|---|---|---|---|---|
| | 200 | 1.04 | ○ | 0.22 | ○ | ○ | ○ |
| | 240 | 1.87 | ○ | 0.15 | ○ | Δ | ○ |
| | 300 | 1.3 | X | 0.12 | ○ | X | X |

TABLE 6

| Electrode Spacing (μm) | Hold voltage (V) | Image density | | Carrier area percentage (%) | | Uniformity | Total evaluation |
|---|---|---|---|---|---|---|---|
| 300 | 150 | 1.84 | ○ | 9.11 | X | Δ | X |
| | 240 | 1.80 | ○ | 0.68 | ○ | X | X |
| | 300 | 1.57 | X | 0.28 | ○ | X | X |
| | 360 | 0.98 | X | 0.13 | ○ | X | X |
| | 450 | 0.54 | X | 0.11 | ○ | X | X |

The results of the experiments are as listed in Tables 5 and 6. From these tables, it is seen that if the electrode spacing ranges from 25 μm to 200 μm, a sufficient image density can be provided without causing a carrier adhesion or image quality uniformity failure. It is also seen that a sufficient image density can be provided without causing a carrier adhesion or image uniformity failure by setting a hold voltage of 0.8 V or more per μm of the electrode spacing in the above-mentioned electrode spacing range.

In contrast, if the electrode spacing is greater than 200 μm, the hold voltage needs to be set high to form an electric field sufficient to hold the developer on the developing roll. Therefore, the developing electric field acting between the photosensitive drum and the developer layer on the developing roll largely changes corresponding to the electrode pattern on the developing roll and density inconsistencies corresponding to the electrode pattern also occur in the developed image.

On the other hand, if the electrode spacing is smaller than 25 μm, it becomes difficult to arrange magnetic carriers along the electric force line of the electric field formed between the adjacent electrodes, and the developer layer becomes uneven. The electric field in a part distant from the surface of the developing roll is attenuated and weakens as the electrode spacing becomes narrower. Therefore, the narrower the electrode spacing, the weaker the binding force of the electric field acting on the magnetic carriers on the developing roll. If the electrode spacing is smaller than 25 μm, carrier adhesion and developer scattering occur.

It the hold voltage is set to less than 0.8 V per μm of the electrode spacing, an electric field sufficient to hold the developer on the developing roll cannot be formed between the adjacent electrodes, thus carrier adhesion and developer scattering occur.

<c. Experiment for maintainability>

Next, an experiment carried out on maintainability of the developing apparatus shown in FIG. 13 will be discussed.

In the experiment, 100,000 sheets of solid images are developed by the developing apparatus shown in FIG. 13 and the statistics of the image density at the time are examined as in the experiment carried out in the developing apparatus shown in FIG. 3.

The developer used in the experiment is that previously described with the configuration of the developing apparatus. The mixing ratio between toner and carriers in the developer is adjusted so that the toner weight percentage in the developer becomes 7.5%–8.5% by weight.

The width of each elongated electrode formed on the peripheral surface of the developing roll and the electrode spacing are set to 100 μm and the voltage applied between the adjacent electrodes is set by 100 V.

Figure 15:
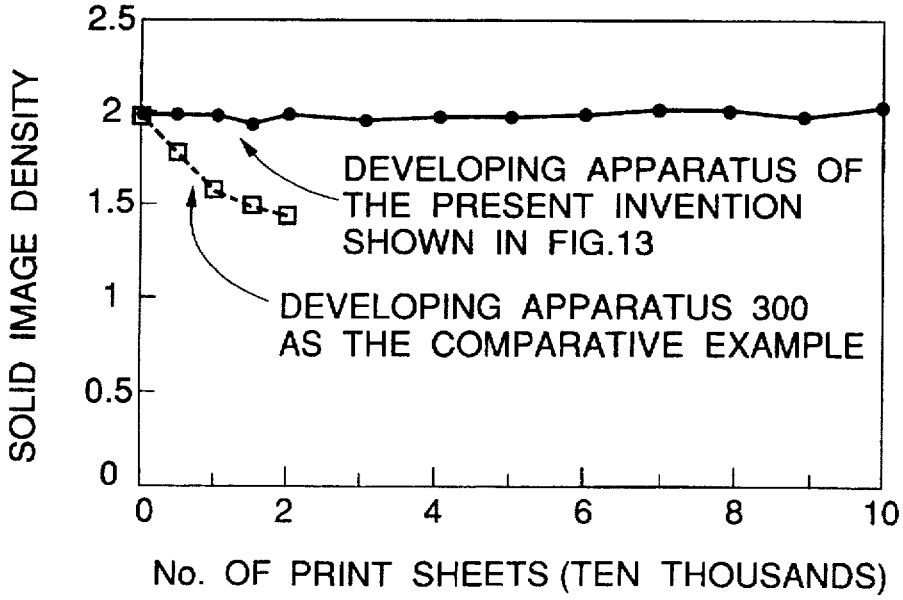
FIG. 15 is a graph to show the relationship between the number of print sheets and the solid image density in the developing apparatuses shown in FIGS. 13 and 8.

FIG. 15 shows the solid image density statistics when the developing apparatus shown in FIG. 13 is used to develop 100,000 sheets. It also shows the result of developing executed by the conventional developing apparatus shown in FIG. 8.

As seen in the figure, the developing apparatus according to the invention maintains the image density good throughout the developing of 100,000 sheets.

As the result of examining the state of the developer after the long-term developing experiment, since the developing apparatus shown in FIG. 13 uses no layer thickness regulation member, no stress acted on the developer when a developer layer was formed and the developer was little degraded although remarkable toner degradation and carrier degradation were observed in the developer used with the conventional developing apparatus.

Thus, the developing apparatus of the invention can stably maintain good image quality over a long term.

In the embodiment, the developer layer on the developing roll is placed out of contact with the photosensitive drum. However, a similar effect is also produced if the developer layer is brought into contact with the photosensitive drum 1.

In the developing apparatus used in the embodiment, the spacing between the adjacent elongated electrodes on the developing roll is set to 100 μm. However, a similar effect is also produced if the electrode spacing is set in the range of 25 μm to 200 μm.

[6. Fifth Embodiment]

Figure 16A:
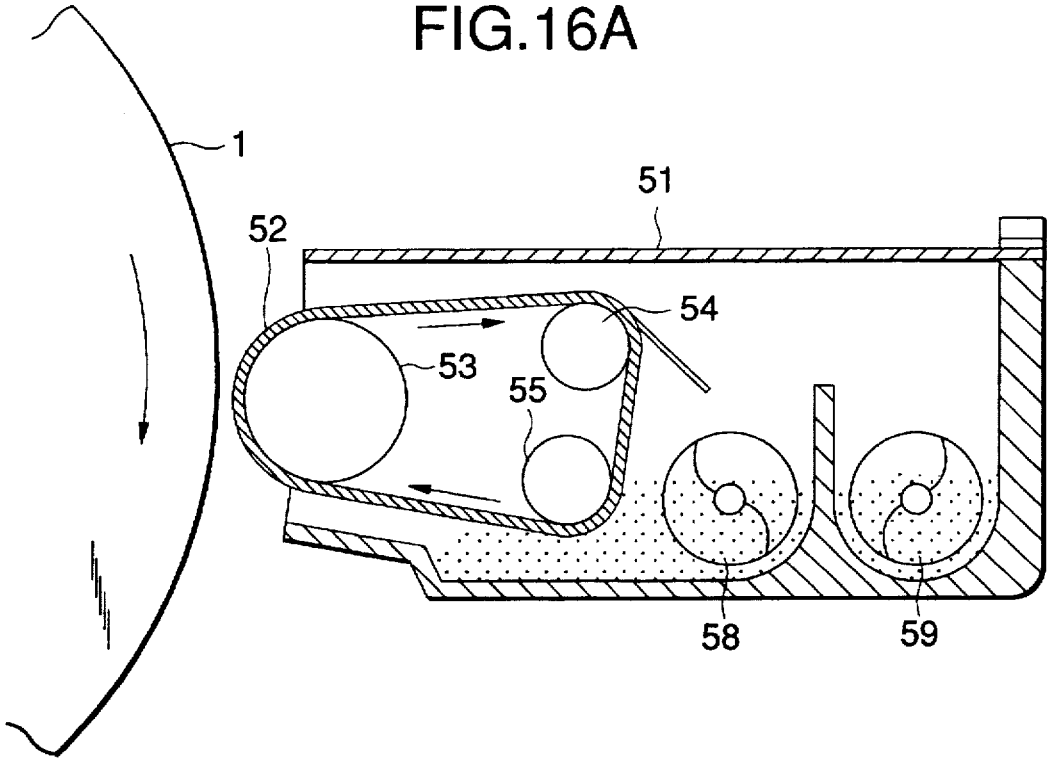
FIGS. 16A–B are schematic diagrams to show the configuration of a developing apparatus of a fifth embodiment of the invention and a partially enlarged sectional view of a developer support used with the developing apparatus.

FIG. 16 is a schematic diagram to show the configuration of a developing apparatus of a fifth embodiment of the invention and a partially enlarged sectional view of a developer support used with the developing apparatus.

The developing apparatus is formed with a developing opening in a part of a developing housing 51 for housing a developing opposite to a photosensitive drum 1 and has a developer support disposed in the opening. It also has a developer agitation and transport chamber at the rear of the developer support, in which two screw augers 58 and 59 are disposed.

The developer support, which is an endless belt 52 placed on a drive roll 53 and two support rolls 54 and 55, is turned in the direction of the arrow shown in the figure by rotation of the drive roll 53. The drive roll 53 is 10 mm in outer diameter and is rotated so that the belt 52 moves at a peripheral speed of 320 mm/s.

Figure 16B:
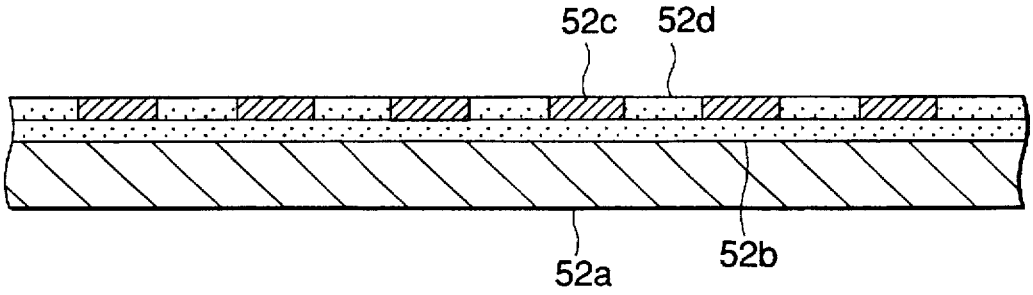
Figure 17:
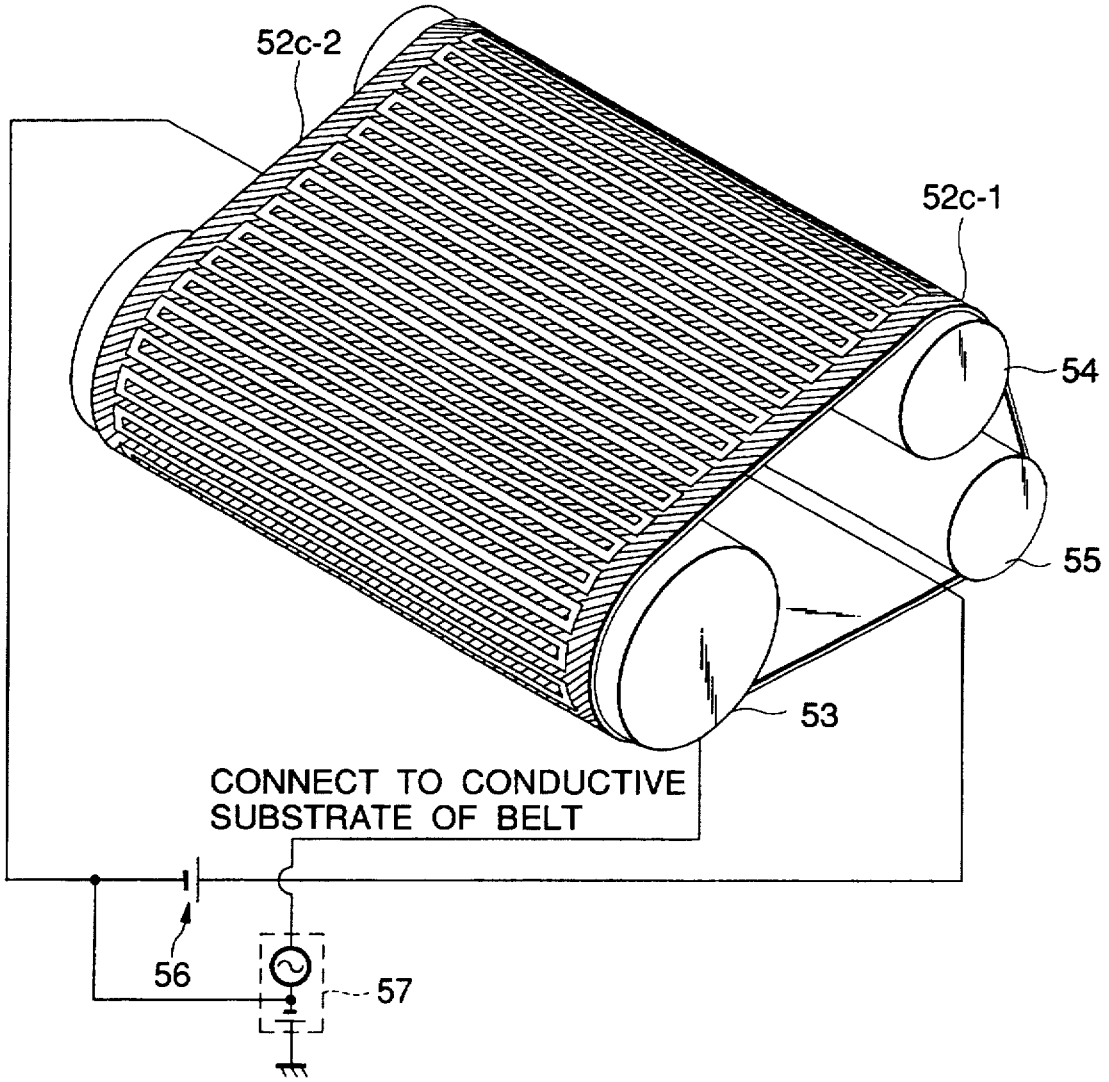
FIG. 17 is a schematic perspective view of the developer support used with the developing apparatus shown in FIG. 16.

As shown in FIG. 16B, the belt 52 has a conductive substrate **52*a*, an insulative layer 52*b* on the conductive substrate 52*a*, and elongated electrodes 52*c* covering almost the entire axial length of the belt, the electrodes 52*c* being laminated on the insulative layer 52*b*. As shown in FIG. 17, the electrodes are connected every other electrode at both side edges of the belt 52 developing roll and form projections like a comb from both sides. An insulating material layer 52*d* is formed between the electrodes 52*c*, so that the belt 52** is finished as a smooth surface.

A developing bias voltage is applied to the conductive substrate **52*a* of the belt 52 from a developing bias power supply 57. It is an AC voltage on which a DC voltage is superposed, and has a DC component set to −400 V and an AC component which is a rectangular wave of frequency 6 kHz and peak-to-peak voltage 1.5 kV. The DC component of the developing bias voltage is applied to one electrode group 52c-1 projecting like a comb from the side edge of the belt 52. A voltage comprising DC voltage superposed on the DC component of the developing bias voltage by a DC power supply 56 is applied to an opposite comb electrode group 52c-2 formed on the peripheral surface of the belt 52. Thus, an electric field is generated between the adjacent electrodes on the belt 52. The voltage of the DC power supply 56 is set so as to generate a 1-V potential difference per μm as the electric field generated between the adjacent electrodes. That is, in the developing apparatus shown in FIGS. 16 and 17**, both the width of each elongated electrode and the gap between the electrodes are set to 100 μm and the potential difference between the adjacent electrodes is set to 100 V.

The dual component developer used with the developing apparatus is the same as the developer used with the developing apparatus shown in FIG. 13.

The developing apparatus of the fifth embodiment is the same as the developing apparatus shown in FIG. 3 in other components.

In the developing apparatus, like the developing apparatus shown in FIG. 13, a thin layer of the developer is formed on the belt almost uniformly without using a layer thickness regulation member and is transported to a developing area for developing an image as the belt turns. Thus, degradation of the developer can be decreased and good images can be provided stably.

An endless belt is used as the developer support as in the developing apparatus, whereby high design flexibility can be provided as compared with the cylindrical form of the developer support. The drive member 53 can be made small in diameter as compared with the cylindrical developer support and the developing opening of the housing 51 can be designed narrow. Therefore, the developing apparatus and the whole image formation system can be downsized. The routing form of the developer support in parts other than the developing part can also be designed as desired and can be easily adapted to the optimum conditions in each part.

[7. Sixth Embodiment]

<a. Configuration and Operation of Developing Apparatus>

Figure 18A:
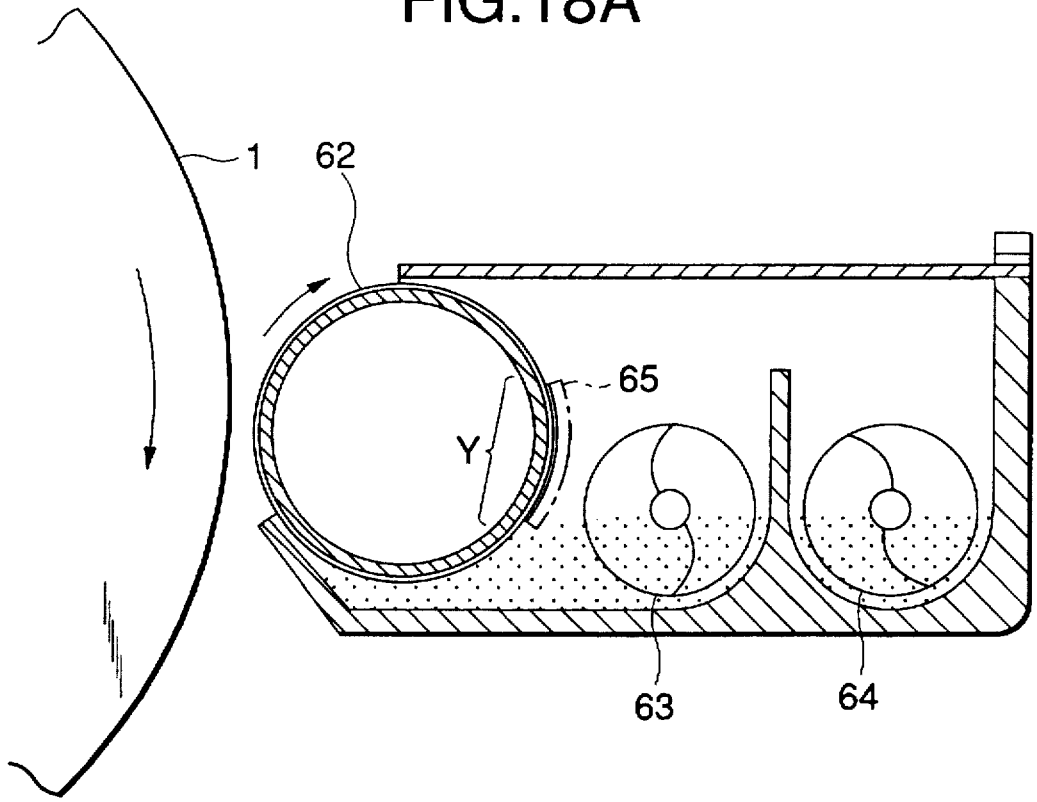
FIGS. 18A–B are schematic diagrams to show the configuration of a developing apparatus of a sixth embodiment of the invention and a partially enlarged sectional view of a developing roll used with the developing apparatus.

FIG. 18 a schematic diagram to show the configuration of a developing apparatus of a sixth embodiment of the invention and a partially enlarged sectional view of a developing roll used with the developing apparatus.

This developing apparatus has a developing roll 62 facing a photosensitive drum 1 and two screw augers 63 and 64 at the rear of the developing roll 62.

Figure 18B:
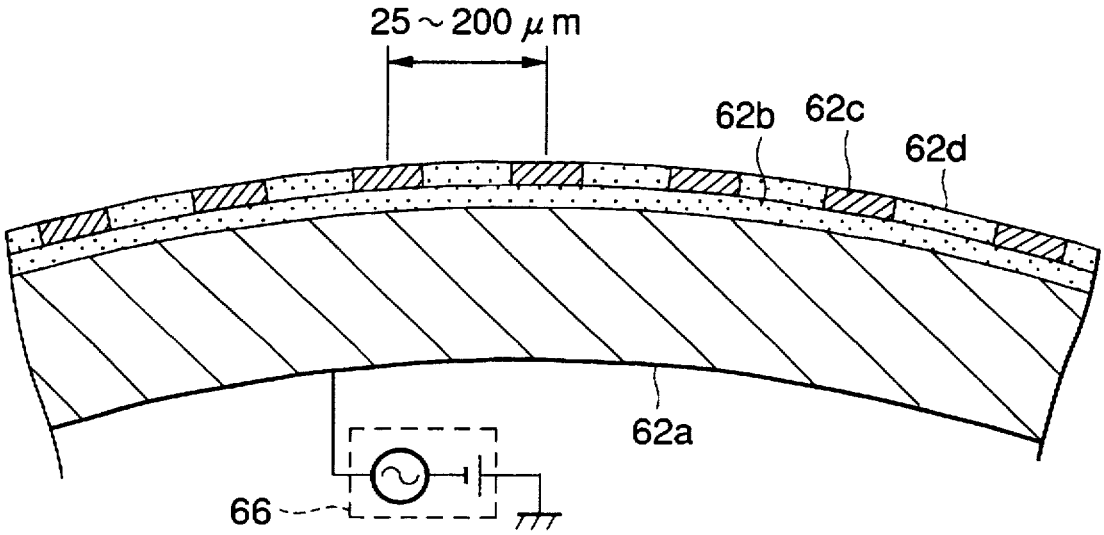

As shown in FIG. 18B, the developing roll 62 has a conductive substrate 62a, an insulative layer 62b on the conductive substrate 62a, and elongated electrodes 62c covering the entire peripheral surface of the developing roll 62 in the axial direction thereof, the electrodes 62c being laminated on the insulative layer 62b. An insulating material layer 62d is formed between the electrodes 62c, so that the developing roll is finished as a smooth surface.

A developing bias voltage is applied to the conductive substrate 62a from a power supply 66. It is an AC voltage on which a DC voltage is superposed, and has a DC component set to −400 V and an AC component which is a rectangular wave of frequency 6 kHz and peak-to-peak voltage 1.5 kV.

Figure 19:
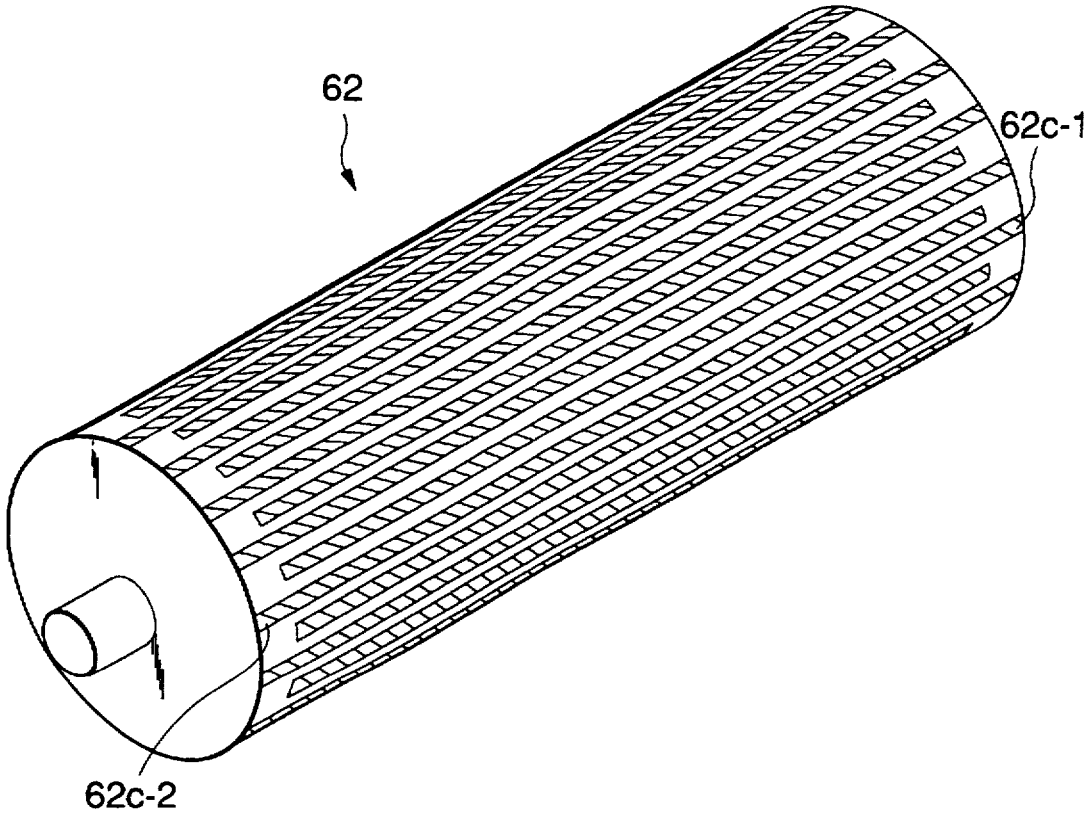
FIG. 19 is a schematic perspective view of the developing roll used with the developing apparatus shown in FIG. 18.
Figure 20:
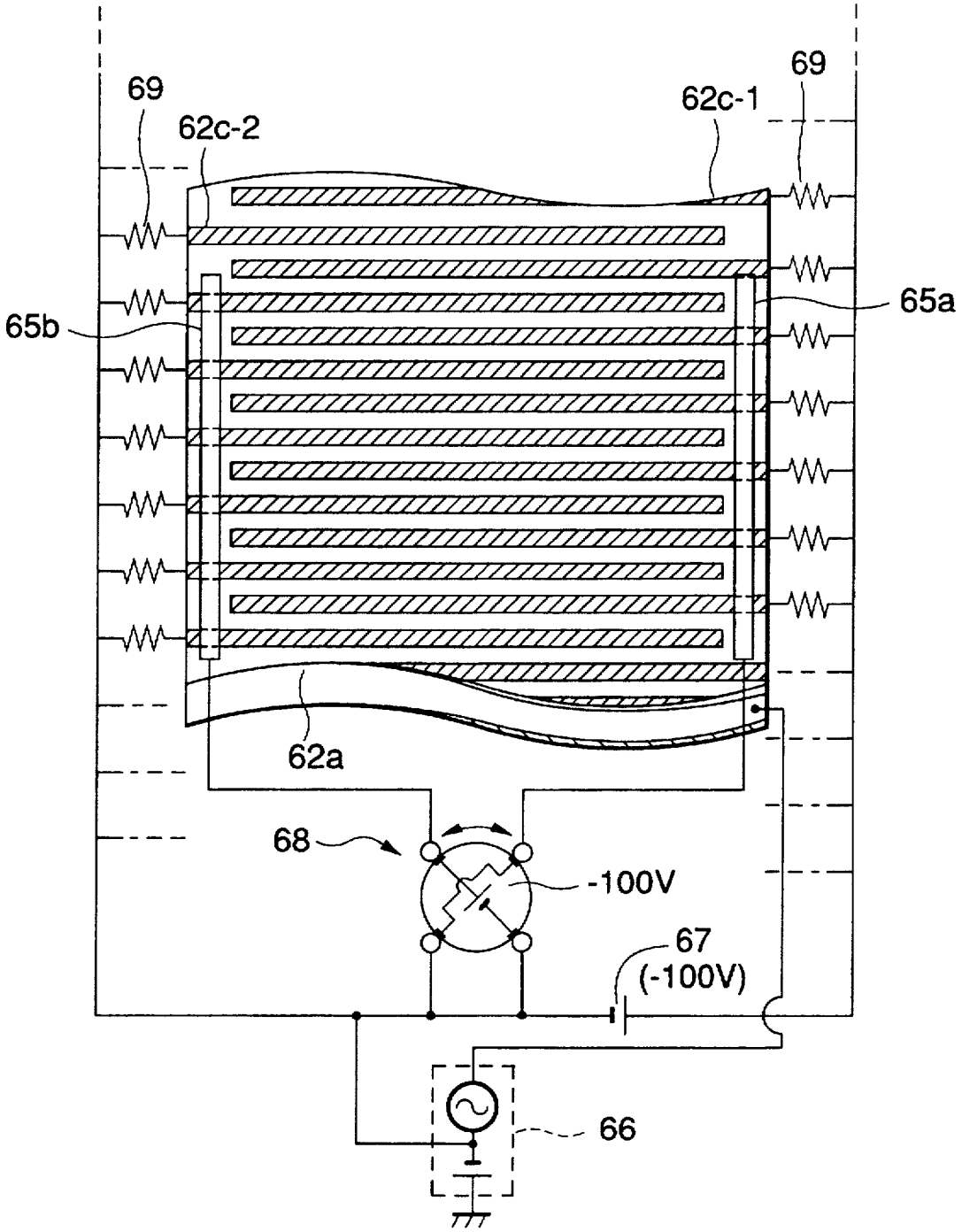
FIG. 20 is a schematic diagram to show the configuration of applying a voltage to electrodes of the developing roll shown in FIG. 19.

Both the width of each elongated electrode 62c and the spacing between the adjacent electrodes are set to 100 μm. These electrodes are separated into first and second groups on alternate electrodes. As shown in FIG. 19, each electrode in the first group, 62c-1, is formed to one end of the developing roll 62 and is cut on the opposite side slightly to the center side from the other end of the developing roll 62. On the other hand, each electrode in the second group 62c-2, is cut slightly to the center side from one end of the developing roll 62, but is formed on the opposite side so as to reach the other end of the developing roll 62. The DC component of the developing bias voltage is applied to the electrode in the first group, 62c-1, via a separate resistor 69. Likewise, a voltage comprising DC voltage (−100 V) superposed on the DC component of the developing bias voltage is applied to the electrode in the second group, 62c-2, via a separate resistor 69. Thus, an electric field is formed between the adjacent electrodes.

The developing apparatus is not provided with a scraper coming in contact with the developing roll 62 and is provided, at positions where a developer should be stripped off, with contactors 65 pressed against the electrodes 62c at both ends of the developing roll 62. The contactors 65 are disposed each at each end of the developing roll 62; one contactor 65a comes in contact with the electrode in the first group, 62c-1, and the other contactor 65b comes in contact with the electrode in the second group, 62c-2. The DC component of the developing bias voltage and the voltage comprising DC voltage (−100 V) superposed on the DC component of the developing bias voltage are alternately applied at frequency 100 Hz to the contactors 65 via a changeover switch.

The developer used with the developing apparatus is the same as the developer used with the developing apparatus shown in FIG. 13 or 16.

Next, the operation of the developing apparatus will be discussed.

When a developer is supplied to the peripheral surface of the developing roll 62 turned, carriers are polarized by the action of an electric field formed between the adjacent electrodes 62c on the peripheral surface and are electrically attracted on the peripheral surface of the developing roll 62. Then, the developer is transported to the developing area for developing an image. The developer passing through the developing area arrives at the portion where the contactors 65 are pressed against the peripheral surface at both ends of the developing roll 62 (area Y shown in FIG. 18A) as the developing roll 62 rotates. In this portion, a voltage whose direction is inverted at frequency 100 Hz is applied between the adjacent electrodes 62c from the contactors 65. Thus, the electric field between the electrodes is inverted and the binding force of the electrically attracted carriers is lost, stripping off the developer from the peripheral surface of the developing roll 62. The stripped-off developer is agitated with a new developer by the screw auger 63 and is again supplied to the developing roll 62.

Thus, a thin layer of the developer is formed on the developing roll without using a layer thickness regulation member and the developer passing through the developing area is stripped off from the developing roll 62 without using a scraper, etc., whereby degradation of the developer can be furthermore decreased.

<b. Experiment on Exchangeability of Developer>

Next, an experiment carried out on exchangeability of the developer on the developing roll by using the developing apparatus will be discussed.

The exchangeability of the developer on the developing roll refers to the property of allowing the developer deposited on the developing roll and passing through the developing area to be stripped off from the developing roll and a new developer sufficiently agitated to be supplied to the developing area. If the exchangeability of the developer is not enough, the developer passing through the developing area is deposited on the developing roll. If it is repeatedly made available for developing, the toner weight percentage in the developer deposited on the developing roll lowers and developing with a sufficient density cannot be executed.

In the experiment, the developing apparatus is used to develop 20,000 sheets of solid images and the image density and the density difference in a single solid image are measured. The image density is measured with a reflective densitometer (trade name: X-RITE310). If the measurement value is 1.8 or more, both the solid image and line image have a sufficient density, thus the image density measurement value 1.8 or more is evaluated as ○ and less than 1.8 as X. As the evaluation on the density difference, the image density is measured at five points in a single solid image. If the measurement value difference is less than 0.1, it is evaluated as ○; if the measurement value difference is 0.1 or more, it is evaluated as X.

Table 7 lists the experiment results. As seen in the table, the developing apparatus shown in FIG. 18 provides sufficient image densities throughout the 20,000-sheet developing experiment with a uniform image density in a single solid image and good exchangeability of developer.

TABLE 7

| No. of print sheets (k sheets) | Image density | | Density difference | | Total evaluation |
|---|---|---|---|---|---|
| 1 | 1.88 | ○ | 0.05 | ○ | ○ |
| 2 | 1.92 | ○ | 0.08 | ○ | ○ |
| 5 | 1.89 | ○ | 0.04 | ○ | ○ |
| 10 | 1.98 | ○ | 0.05 | ○ | ○ |
| 20 | 1.84 | ○ | 0.06 | ○ | ○ |

[8. Seventh Embodiment]

<a. Configuration and Operation of Developing Apparatus>

Figure 21A:
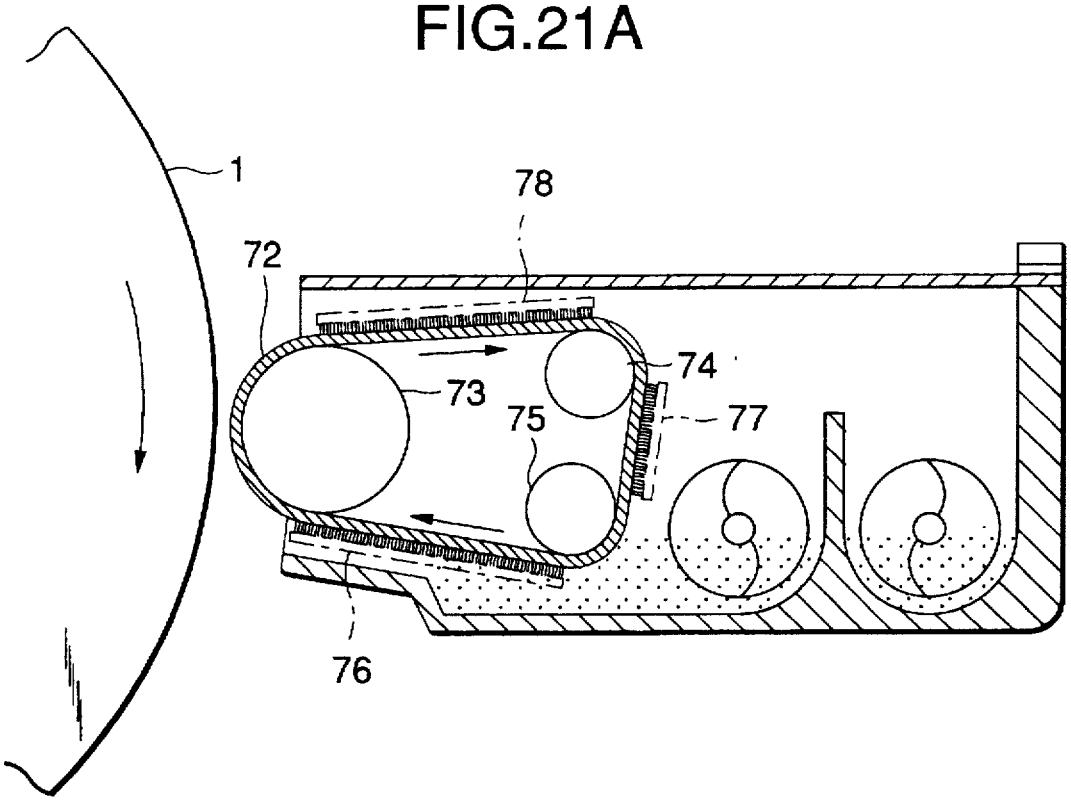
FIGS. 21A–B are schematic diagrams to show the configuration of a developing apparatus of a seventh embodiment of the invention and a partially enlarged sectional view of a developer support used with the developing apparatus.

FIG. 21 is a schematic diagram to show the configuration of a developing apparatus of a seventh embodiment of the invention and a partially enlarged sectional view of a developer support used with the developing apparatus.

The developing apparatus has a developer support facing a photosensitive drum 1, the developer support being a belt 72 placed on a drive roll 73 and two support rolls 74 and 75. The drive roll 73 has magnetic poles on almost all peripheral surface, as shown in FIG. 21B.

Figure 23:
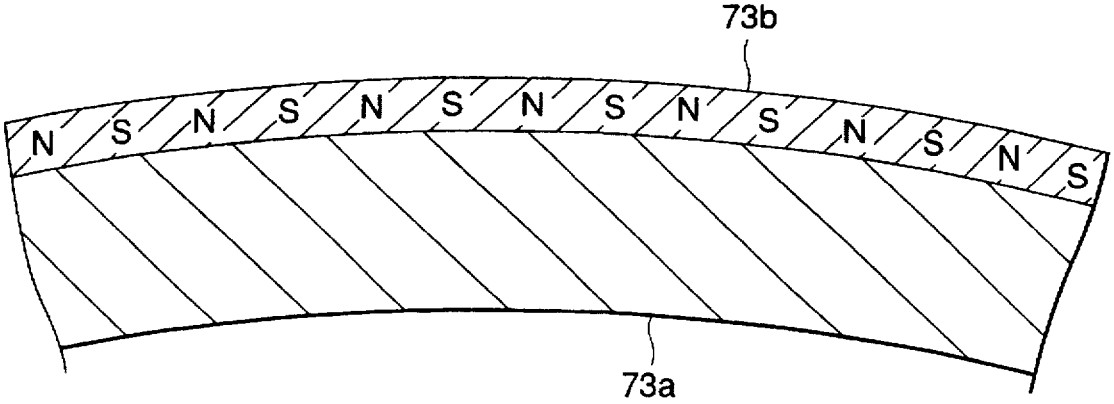
FIG. 23 is a partially enlarged sectional view of a drive roll used with the developing apparatus shown in FIG. 21.

The drive roll 73 comprises a magnetic recording layer **73*b* formed on the peripheral surface of a cylindrical base substance 73*a*, as shown in FIG. 23. The magnetic poles continuous in the axial direction of the drive roll 73 are magnetized in the magnetic recording layer 73*b* according to an alternating pattern of S and N poles in the circumferential direction. The center distance between the magnetic poles is set so that the peak position spacing of the magnetic flux density on the outer peripheral surface of the belt 72 placed on the drive roll 73 becomes 100 μm, and the magnetic field strength is 50 mT (peak value) on the outer peripheral surface of the belt 72. Formation and magnetization of the magnetic recording layer 73*b* can be executed like those of the developing roll of the developing apparatus shown in FIG. 3. The thickness and material of the magnetic recording layer 73*b* can also be the same as those of the developing roll of the developing apparatus shown in FIG. 3**.

Figure 21B:
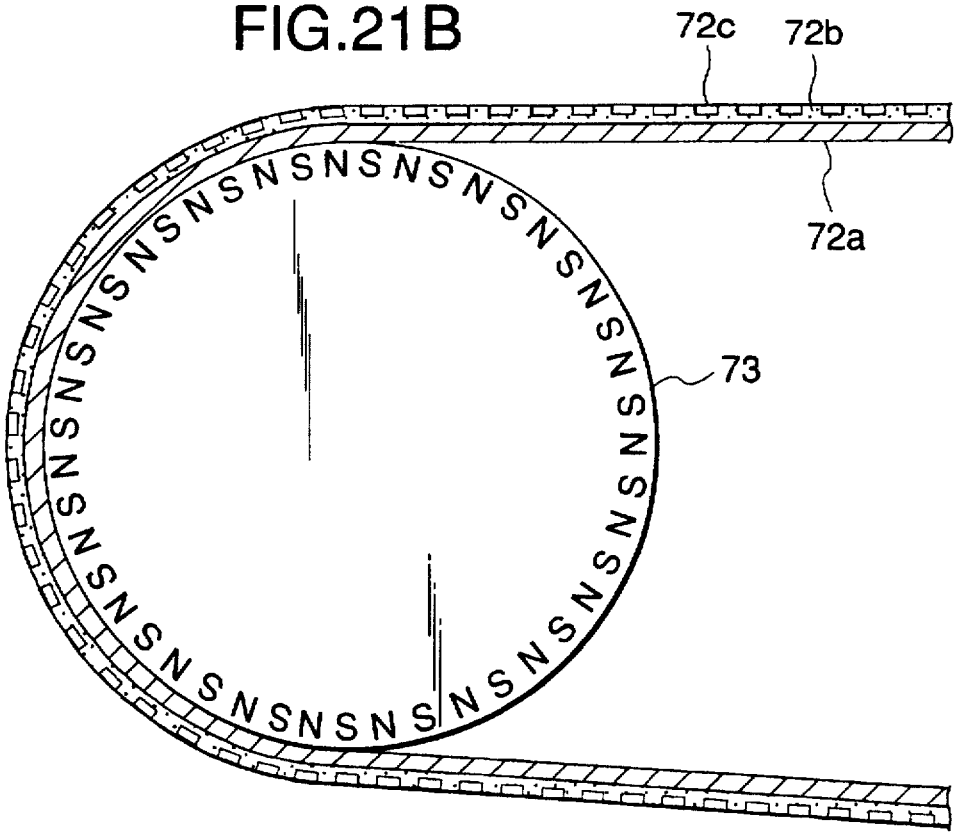
Figure 22:
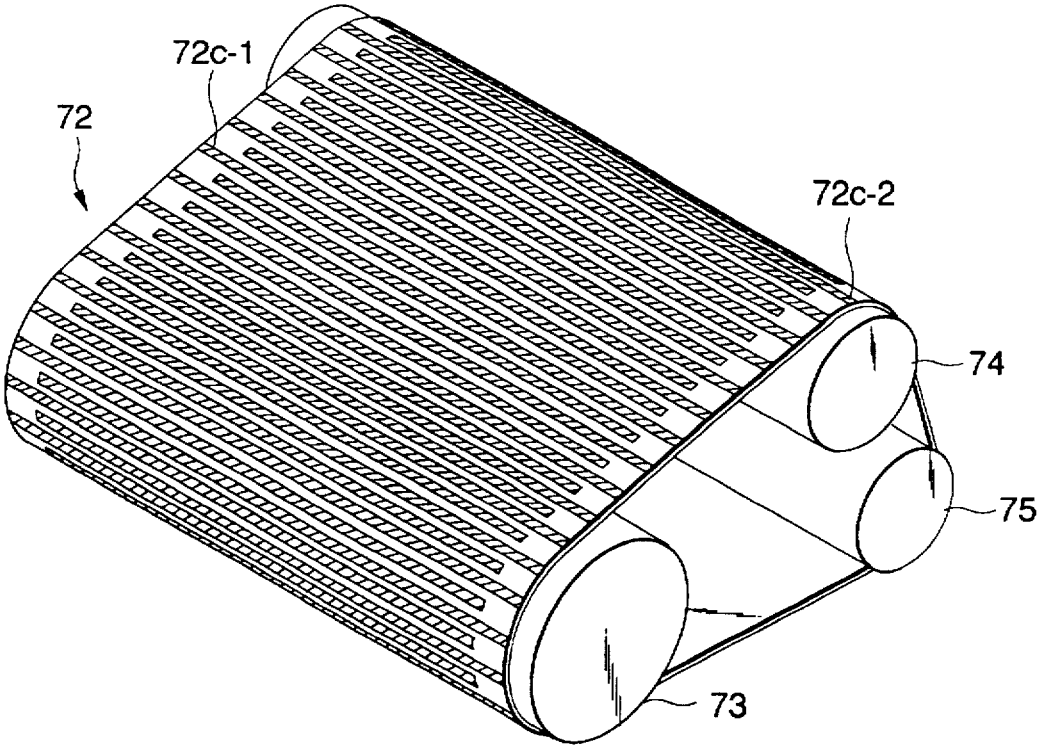
FIG. 22 is a schematic perspective view of the developer support used with the developing apparatus shown in FIG. 21.
Figure 24B:
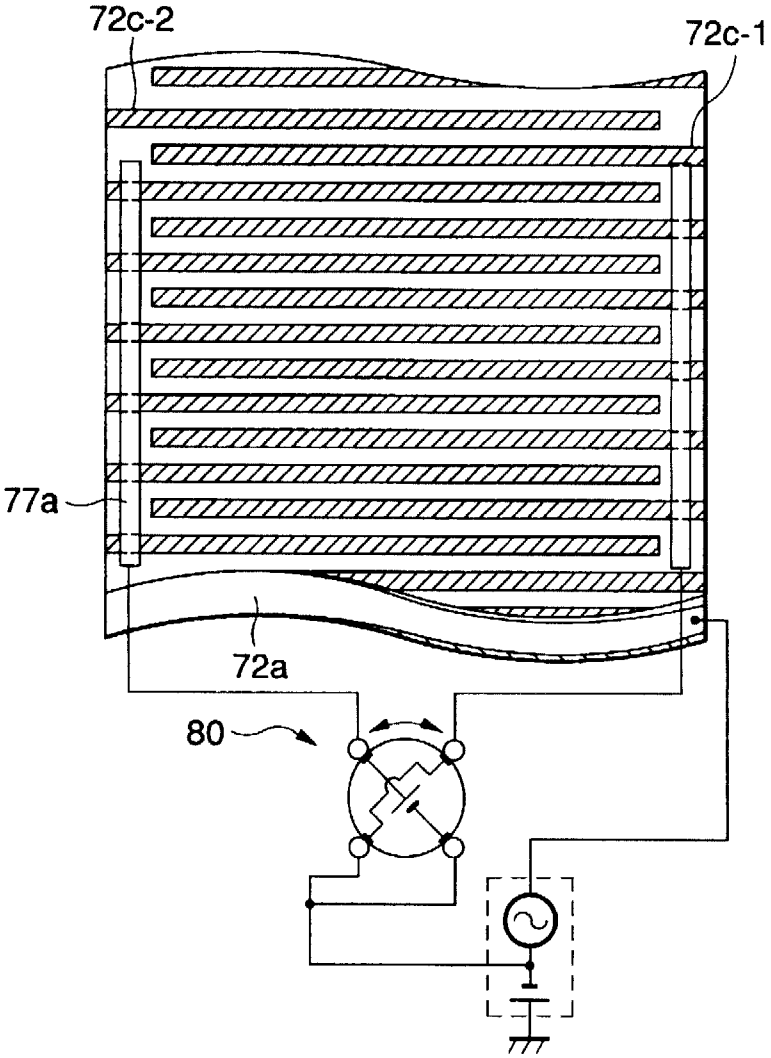
FIGS. 24A–B are illustrations to show the configurations of applying voltages to electrodes disposed on the peripheral surface of the developer support shown in FIG. 21 in a developing area and a developer stripping-off area of the developer support.
Figure 24A:
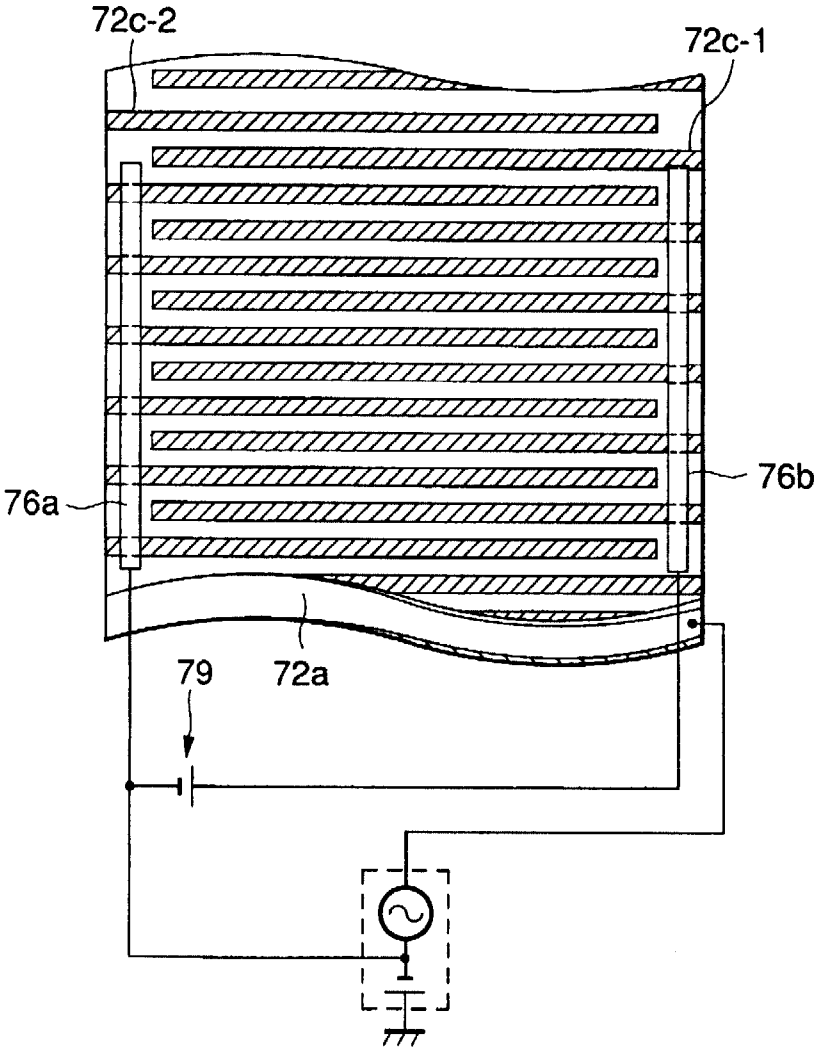

As shown in FIG. 21B, the belt 72 has a conductive substrate **72*a*, an insulative layer 72*b* on the conductive substrate 72*a*, and elongated electrodes 72*c* laminated on the insulative layer 72*b* over all periphery in the width direction of the belt 72. A developing bias voltage is applied to the conductive substrate 72*a*. The elongated electrodes 72*c* extend over all periphery in the width direction of the belt 72 and the distance between the centers of the adjacent electrodes is 100 μm. As shown in FIG. 22, the electrodes are separated into first and second groups on alternate electrodes. That is, each electrode in the first group, 72*c*-1, is formed from one side edge to the center side slightly from the other side edge and each electrode in the second group, 72*c*-2, is formed from the other side edge to the center side slightly from the side edge on the opposite side. As shown in FIG. 24A, at a developer attraction position, a DC component of the developing bias voltage is applied to the electrode in the second group, 72*c*-2, from one contactor 76*a* of two contactors 76 and a voltage comprising DC voltage (−100 V) superposed on the DC component of the developing bias voltage is applied to the electrode in the first group, 72*c*-1, from the other contactor 76*b*, as in the developing apparatus shown in FIG. 18**.

Two contactors 78 are pressed downstream from the drive roll 73 in the transport direction of the belt. Here, as at the developer attraction position shown in FIG. 24A, the DC component of the developing bias voltage is applied to the electrode in the second group, **72*c*-2, through one contactor 78*a* of the contactors 78 and the voltage comprising DC voltage (−100 V) superposed on the DC component of the developing bias voltage is applied to the electrode in the first group, 72*c*-1, through the other contactor 78*b***.

Further, two contactors 77 are pressed at positions where a developer should be stripped off in the vicinity of both side edges of the belt. As shown in FIG. 24B, the DC component of the developing bias voltage is applied to the electrode in the first group, **72*c*-1, through one contactor 77*b* of the contactors 77 and the voltage comprising DC voltage (−100 V) superposed on the DC component of the developing bias voltage is applied to the electrode in the second group, 72*c*-2, through the other contactor 77*a***; the voltage application direction is inverted at frequency 100 Hz.

Next, the operation of the developing apparatus will be discussed.

In the developing apparatus, at the developer attraction position, a developer supplied to the peripheral surface of the belt 72 is attracted on the peripheral surface of the belt 72 by the action of an electric field produced between the electrodes **72*c*, forming a thin layer of the developer, as in the developing apparatus shown in FIG. 16 or 18**.

As the belt turns, the thin layer of the developer is transported and arrives at the developing area facing the photosensitive drum 1. Since the developing bias voltage is not applied to any electrodes in the first or second group in the developing area, no electric field occurs between the electrodes and a force of binding carriers in the developer to the peripheral surface of the belt does not act. However, the carriers are attracted on the peripheral surface of the belt by the magnetic poles magnetized on the peripheral surface of the drive roll 73 placed so as to face the photosensitive drum 1 via the belt 72, thereby preventing scattering and transfer of the carriers to the photosensitive drum 1. Since the magnetic poles on the drive roll 73 are placed so as to match the electrode **72*c* spacing, the developer attracted on the peripheral surface of the belt 72 is not agitated or scattered and does not change in the state of the layer thickness, etc.; it makes the transition from the electric field attraction state to the magnetic field attraction state. In the developing area, charged toner is transferred by the action of an electric field formed between the belt 72 and the photosensitive drum 1, thereby developing an electrostatic latent image on the photosensitive drum 1**.

After passing through the developing area, the developer on the belt 72 again makes the transition from the magnetic field attraction state to the state in which the developer is attracted by the action of the electric field produced between the adjacent electrodes 72*c* via the contactors 78, and is transferred to the rear of the developer support.

As shown in FIG. 24B, in the area of stripping off the developer from the belt in the rear part of the developer support, a voltage whose direction is inverted is applied between the adjacent electrodes via the contactors 77 and the developer on the belt is stripped off as with the developing apparatus shown in FIG. 18.

Thus, in the developing apparatus, a thin layer of the developer is formed on the belt without using a layer thickness regulation member and after developing, the developer is stripped off from the belt without using a scraper, so that degradation of the developer can be extremely lessened. In the developing area, a uniform electric field can be formed for developing with no density inconsistencies.

<b. Experiment for Examining Relationships Between Electrode Spacing and Magnetic Pole Spacing and Occurrence of Density Inconsistencies>

Next, we will discuss an experiment of examining occurrence of density inconsistencies of an image by changing the distance between the centers of the electrodes formed on the belt and magnetic pole spacing formed on the peripheral surface of the drive roll.

In the experiment, four types of belts with the distance between the centers of the adjacent electrodes set to 25 μm, 60 μm, 140 μm, 250 μm are used. The belts are manufactured so that the width of each electrode equals the electrode spacing. On the other hand, five types of drive rolls magnetized so that the magnetic pole spacing on the peripheral surface of the belt placed on the drive roll becomes 25 μm, 60 μm, 100 μm, 140 μm, 250 μm are used. These belts and drive rolls are used in combination for developing solid images. Occurrence of the density inconsistencies of each developed image is observed in visual check. The results are as listed in Table 8, wherein if no density inconsistencies are acknowledged in the visual check, the state is evaluated as ○; a level at which there is no problem on practical use although slight density inconsistencies are acknowledged is set to Δ; and an unavailable level set to X.

TABLE 8

| Magnetic pole spacing (μm) | Center-to-center distance (μm) | Density inconsistencies |
|---|---|---|
| 25 | 25 | ○ |
| | 60 | X |
| | 140 | X |
| | 350 | Δ |
| 60 | 25 | X |
| | 60 | ○ |
| | 140 | X |
| | 350 | X |
| 100 | 25 | Δ |
| | 60 | X |
| | 140 | X |
| | 350 | X |
| 140 | 25 | X |
| | 60 | X |
| | 140 | ○ |
| | 350 | X |

TABLE 8-continued

| Magnetic pole spacing (μm) | Center-to-center distance (μm) | Density inconsistencies |
|---|---|---|
| 250 | 25 | Δ |
| | 60 | X |
| | 140 | X |
| | 350 | X |

From the table, it is seen that when the magnetic pole spacing is an integer multiple of the center-to-center distance of the electrodes or the center-to-center distance of the electrodes is an integer multiple of the magnetic pole spacing, good developing with no density inconsistencies is enabled. The possible reason is that when the condition is satisfied, the transition from the state in which carriers are attracted on the belt by the action of the electric field to the state in which the carriers are attracted on the belt by the action of the magnetic field is made without disturbing the developer layer. If the condition is not satisfied, the developer layer is disturbed at the transition time and the thickness of the developer layer on the belt becomes uneven.

[9. Eighth Embodiment]

Figure 25A:
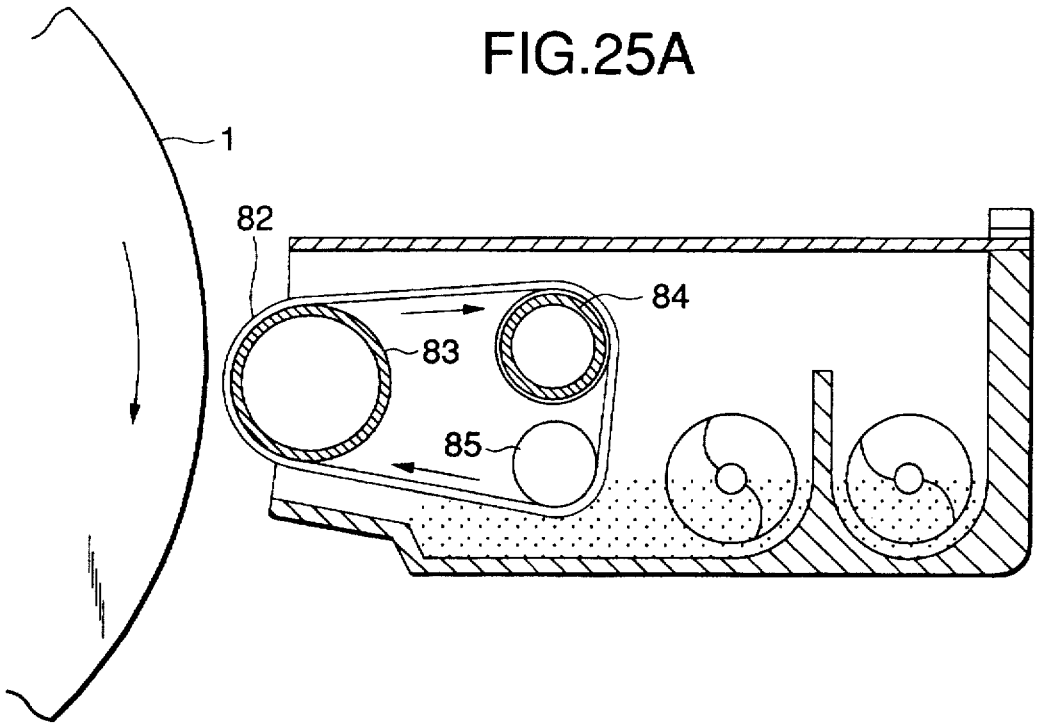
FIGS. 25A–B are schematic diagrams to show the configuration of a developing apparatus of an eighth embodiment of the invention and a partially enlarged sectional view of a developer support used with the developing apparatus.

FIG. 25 is a schematic diagram to show the configuration of a developing apparatus of an eighth embodiment of the invention and a partially enlarged sectional view of a developer support used with the developing apparatus.

The developing apparatus has a developer support, which is an endless belt 82 placed on a drive roll 83 and two support rolls 84 and 85 like the developing apparatus shown in FIG. 21.

Figure 25B:
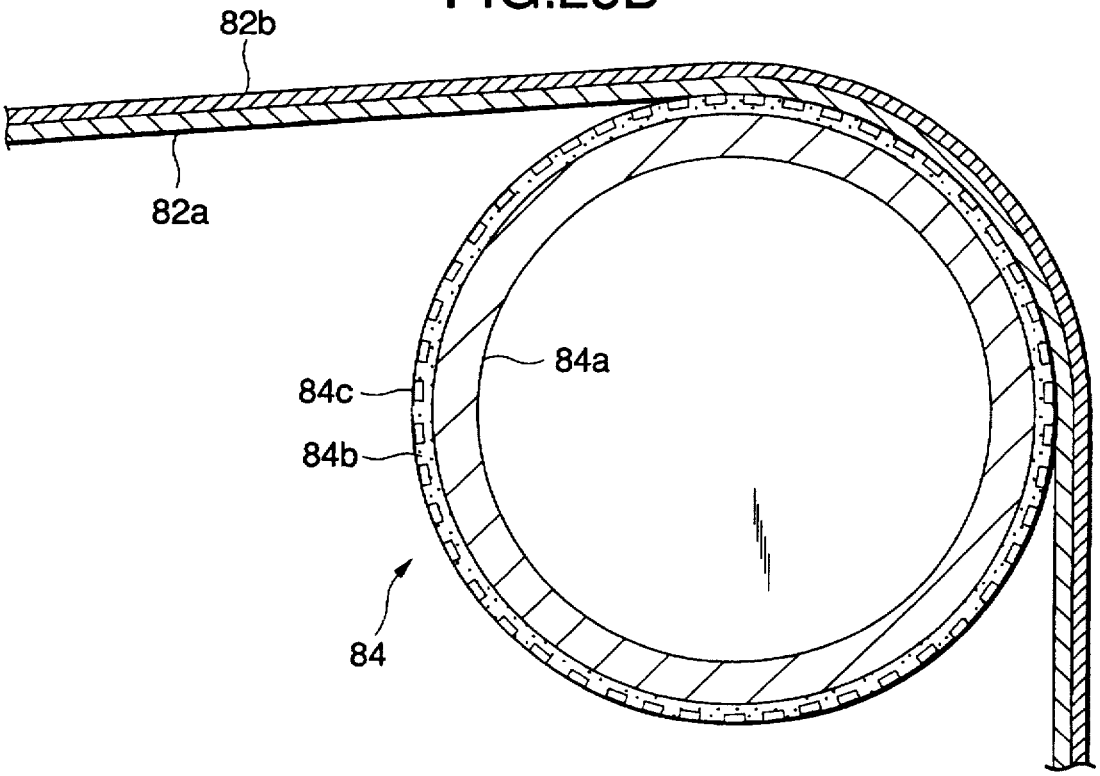

As shown in FIG. 25B, the belt 82 has an insulative substrate 82*a* and a magnetic recording layer 82*b* formed on the insulative substrate 82*a*. The magnetic recording layer 82*b* has N and S poles magnetized alternately in an equal spacing according to a sine wave pattern in the circumferential direction of the belt over all periphery.

Figure 26:
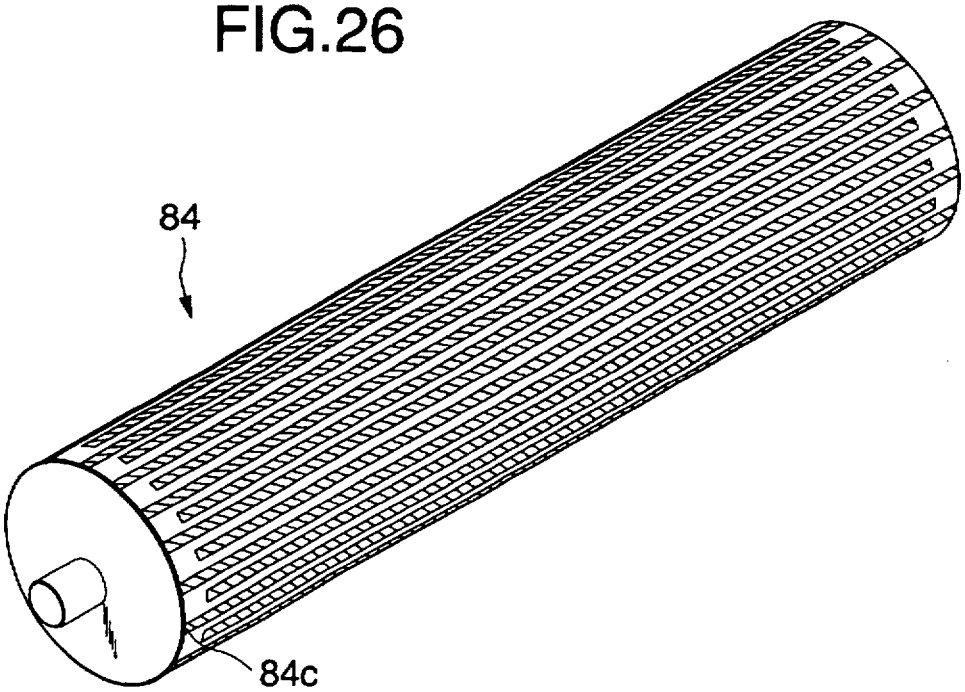
FIG. 26 is a schematic perspective view of a support roll used with the developing apparatus shown in FIG. 25.

As shown in FIGS. 25B and 26, one of the support rolls, 84, has a cylindrical substrate 84*a*, an insulative layer 84*b* formed on the peripheral surface of the substrate 84*a*, and a plurality of elongated electrodes 84*c* on the insulative layer 84*b* over all periphery. The electrodes 84*c* are disposed over almost the entire length of the support roll 84 in the axial direction thereof so that the distance between the centers of the electrodes 84*c* matches the peak position spacing of the magnetic flux density on the outer peripheral surface of the belt 82 placed on the support roll 84. The electrodes 84*c* are separated into two groups on alternate electrodes, to which a DC voltage (−100 V) is applied alternately at frequency 100 Hz.

The drive roll 83 has a main section made of a conductive cylinder to which a developing bias voltage is applied.

In the developing apparatus, magnetic carriers supplied to the peripheral surface of the belt 82 are attracted on the belt 82 by the magnetic poles disposed in the magnetic recording layer 82*b*, forming a thin layer of the developer. As the belt 82 turns, the thin layer of the developer is transported to a developing area where an electric field is formed between a photosensitive drum 1 and the drive roll 83 to which the developing bias voltage is applied and toner is transferred from the developer on the belt 82 to an electrostatic latent image on the photosensitive drum 1 for developing the image. At this time, the developer is attracted on the belt by a magnetic force and the potential in the vicinity of the belt in the developing area becomes almost uniform, so that good developing with no density inconsistencies is executed.

The developer passing through the developing area arrives at a position wound around the support roll 84 as the belt 82 turns. At this time, an electric field is formed between the adjacent electrodes 84*c* on the peripheral surface of the support roll 84, causing carriers to polarize. Since the direction of the electric field is inverted cyclically, a force for attempting to vibrate the carriers acts on the carriers. It causes the carriers to be released from binding of the magnetic poles on the belt 82 and drop into a developer pool. Thus, a thin layer of the developer is formed on the belt without using a layer thickness regulation member, etc., and the developer is stripped off from the belt without using a scraper, etc., whereby degradation of the developer can be decreased.

[10. Ninth Embodiment]

Figure 27A:
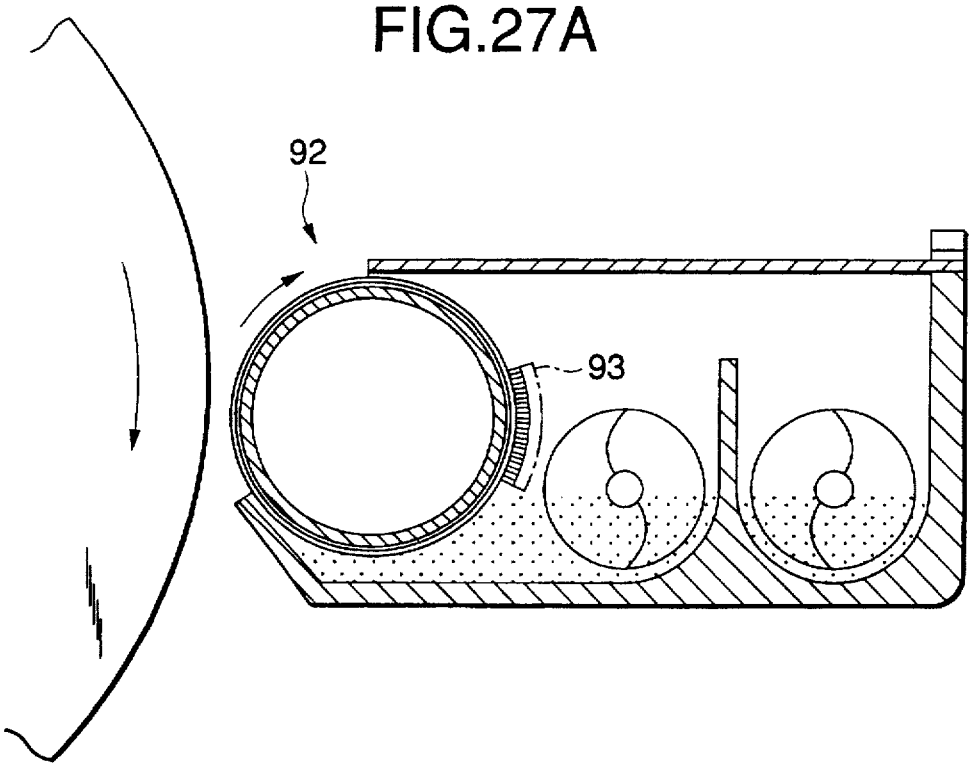
FIGS. 27A–B are schematic diagrams to show the configuration of a developing apparatus of a ninth embodiment of the invention and a partially enlarged sectional view of a developing roll used with the developing apparatus.

FIG. 27 is a schematic diagram to show the configuration of a developing apparatus of a ninth embodiment of the invention and a partially enlarged sectional view of a developing roll used with the developing apparatus.

The developing apparatus uses a developing roll 92 as a developer support, which faces a photosensitive drum 1 and is supported for axial rotation.

Figure 27B:
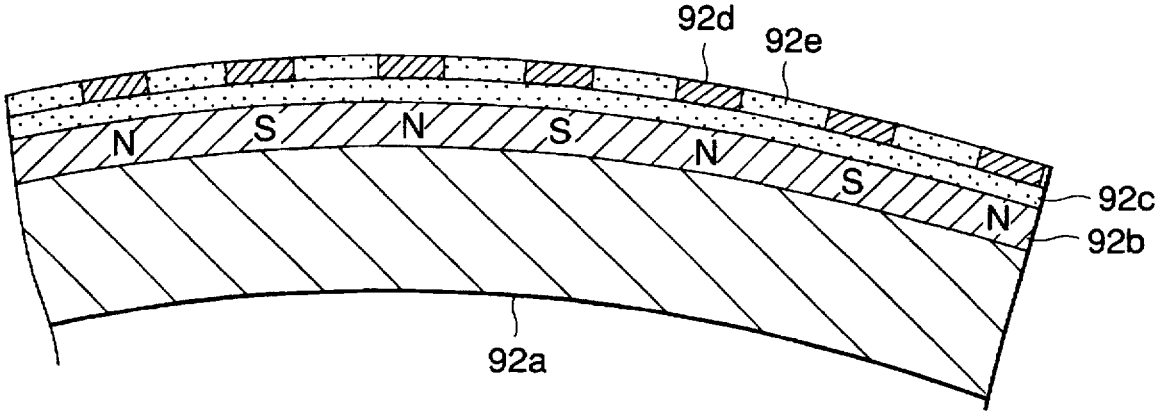
Figure 28:
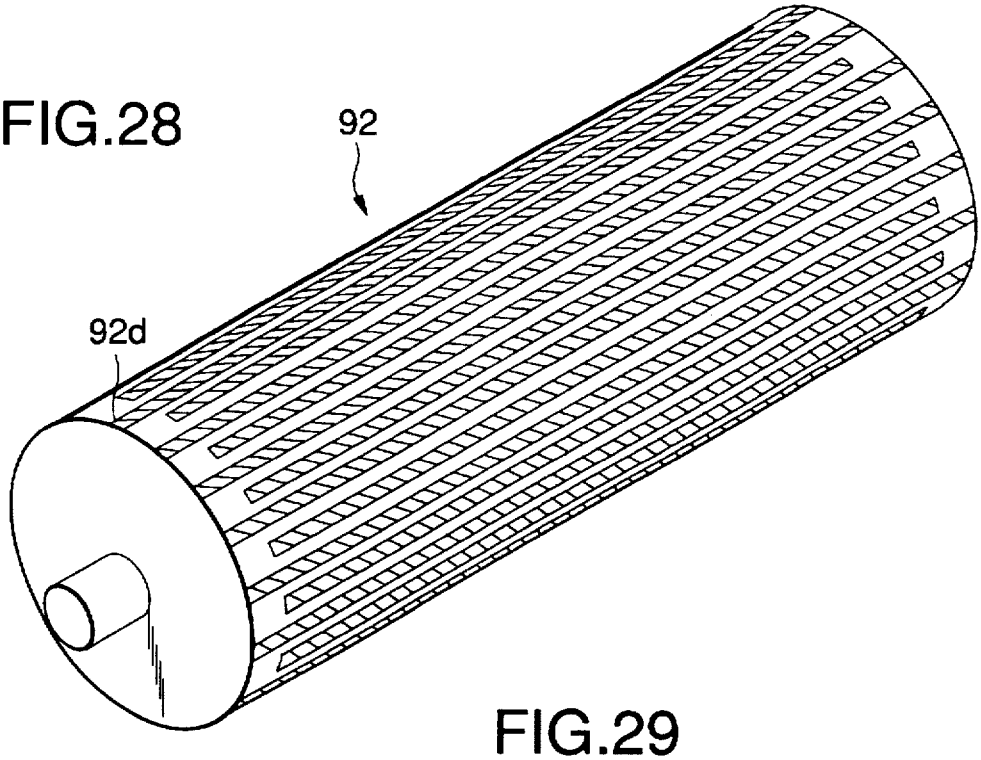
FIG. 28 is a schematic perspective view of the developing roll used with the developing apparatus shown in FIG. 27.

As shown in FIG. 27B, the developing roll 92 has a cylindrical conductive substrate 92*a*, a magnetic recording layer 92*b* laminated on the conductive substrate 92*a*, an insulative layer 92*c* laminated on the magnetic recording layer 92*b*, and elongated electrodes 92*d* laminated on the insulative layer 92*c*. A developing bias voltage is applied to the conductive substrate 92*a*. The magnetic recording layer 92*b* has N and S poles magnetized alternately in an equal spacing according to a sine wave pattern in the circumferential direction of the developing roll over all periphery, as in the developing apparatus shown in FIG. 3. As shown in FIG. 28, the elongated electrodes 92*d* are formed in the axial direction of the developing roll 92 and the distance between the centers of the adjacent electrodes is set to 50 μm so as to match the peak position spacing of the magnetic flux density on the outer peripheral surface of the developing roll 92.

Figure 29:
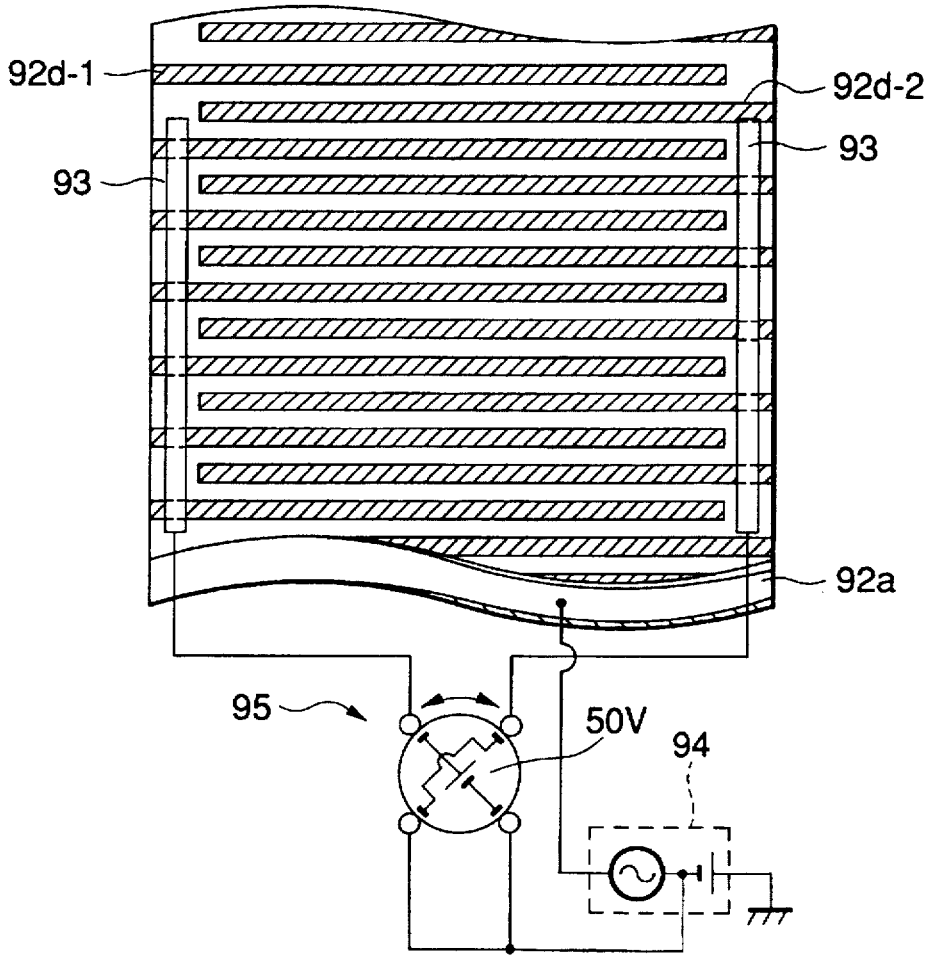
FIG. 29 is an illustration to show the configuration of applying voltage to electrodes disposed on the peripheral surface of the developing roll in a developer stripping-off area of the developing roll shown in FIG. 28.

At positions stripping off a developer set at the rear of the developing roll 92, contactors 93 are pressed in the vicinity of both ends of the developing roll 92. As shown in FIG. 29, the DC component of the developing bias voltage and the voltage comprising DC voltage (50 V) superposed on the DC component of the developing bias voltage are applied alternately at frequency 100 Hz from the contactors 93 to two electrode groups 92*d*-1 and 92*d*-2 into which the parallel electrodes are separated on alternate electrodes, whereby an electric field is produced between the adjacent electrodes and the direction of the electric field is inverted cyclically.

In the developing apparatus, carriers are attracted by the magnetic poles disposed in the magnetic recording layer 92*b*, forming a thin layer of the developer on the surface of the developing roll 92. The developer layer is made available for developing in a state in which it is substantially attracted, and again is restored to a housing of the developing apparatus. At this time, in the parts where the contactors 93 are pressed, an electric field inverted cyclically is formed between the adjacent electrodes 92*d* on the developing roll 92, so that polarized carriers are vibrated. The carriers magnetically attracted on the developing roll 92 are stripped off by the vibration force.

Formation of the developer layer and stripping off the developer from the developing roll 92 are thus executed, whereby degradation of the developer can be suppressed to an extremely low level.

[11. Tenth Embodiment]

Figure 30A:
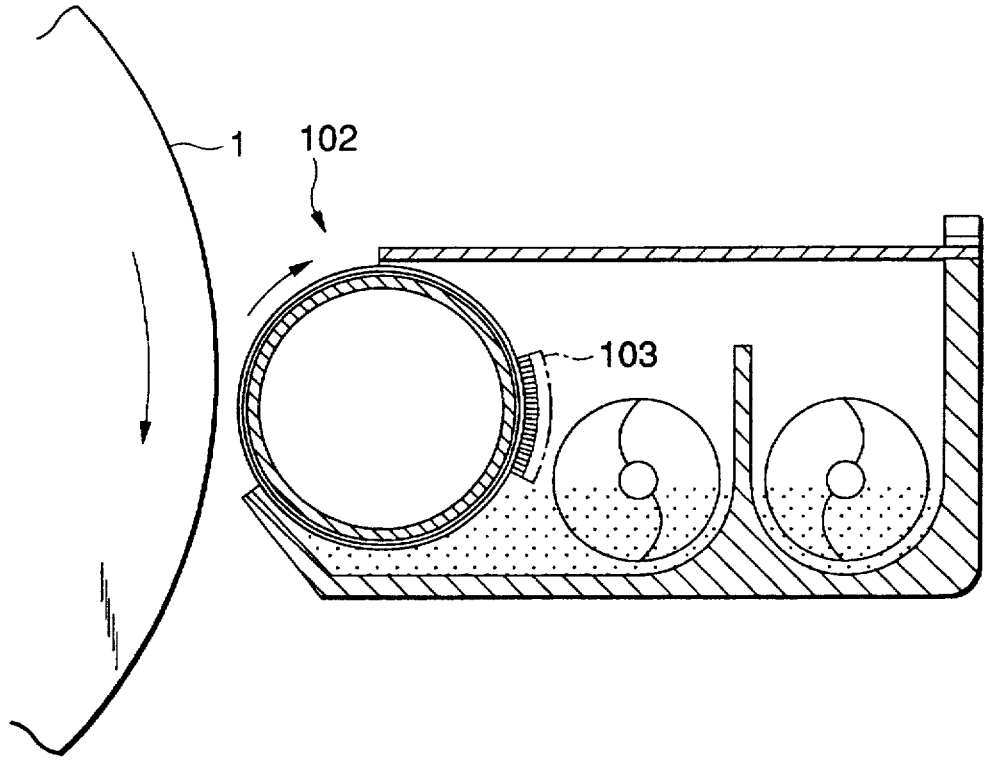
FIGS. 30A–B are schematic diagrams to show the configuration of a developing apparatus of a tenth embodiment of the invention and a partially enlarged sectional view of a developing roll used with the developing apparatus.

FIG. 30 is a schematic diagram to show the configuration of a developing apparatus of a tenth embodiment of the invention and a partially enlarged sectional view of a developing roll used with the developing apparatus.

Figure 30B:
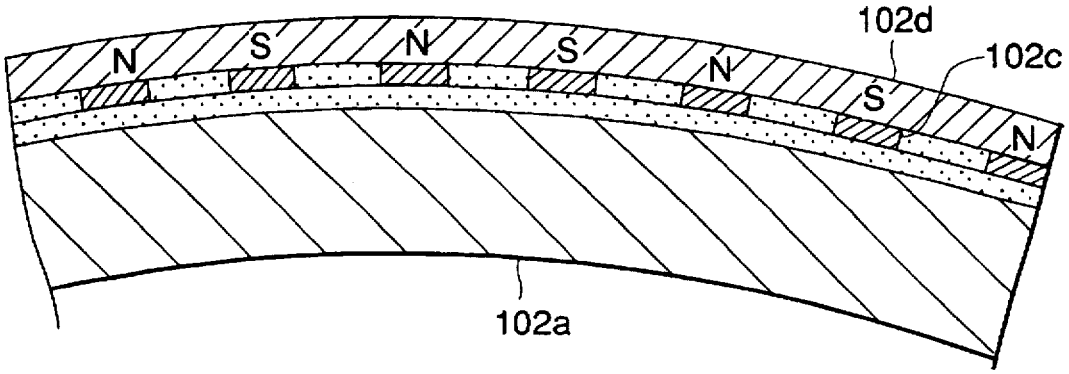

The developing apparatus uses a developing roll 102 as a developer support like the developing apparatus shown in FIG. 27. As shown in FIG. 30B, the developing roll 102 has a cylindrical conductive substrate 102*a*, an insulative layer 102*b*, and electrodes 102*c* laminated via the insulative layer 102*b* on the outer peripheral surface of the conductive substrate 102*a*. A magnetic recording layer 102*d* is laminated so as to cover the electrodes.

A developing bias voltage is applied to the conductive substrate 102*a*, forming an electric field between the developing roll 102 and a photosensitive roll 1.

Figure 31:
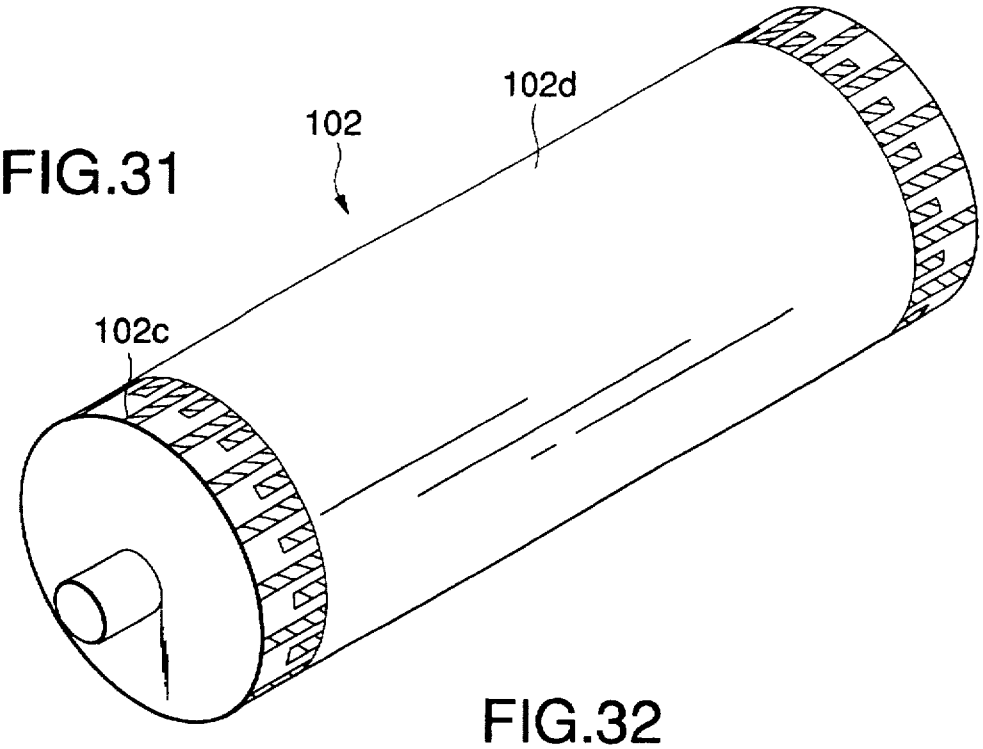
FIG. 31 is a schematic perspective view of the developing roll used with the developing apparatus shown in FIG. 30.

The electrodes 102*c* are formed below the magnetic recording layer 102*d* unlike the electrodes of the developing apparatus shown in FIG. 27, but are the same as the electrodes of the developing apparatus shown in FIG. 27 in shape, material, etc. As shown in FIG. 31, the magnetic recording layer 102*d* is formed so as to cover the electrodes 102*c* in the axial center portion of the developing roll 102 and expose the electrodes 102*c* at both ends of the developing roll 102. S and N poles are magnetized alternately in the magnetic recording layer 102*d*, and the peak position spacing of the magnetic flux density on the outer peripheral surface of the developing roll 102 matches the distance between the centers of the electrodes 102*c*.

The magnetic recording layer 102*d* can be made of the same material as that of the developing apparatus shown in FIG. 3.

Figure 32:
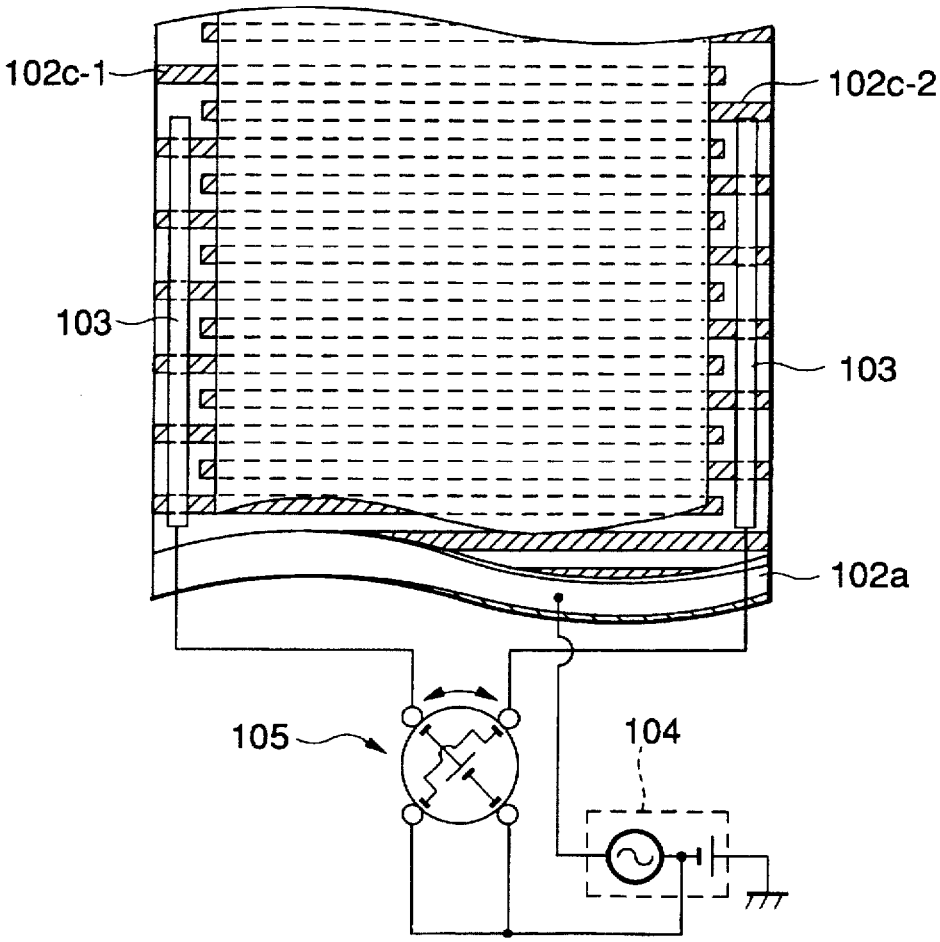
FIG. 32 is an illustration to show the configuration of applying voltage to electrodes disposed on the peripheral surface of the developing roll in a developer stripping-off area of the developing roll shown in FIG. 30.
Figure 33:
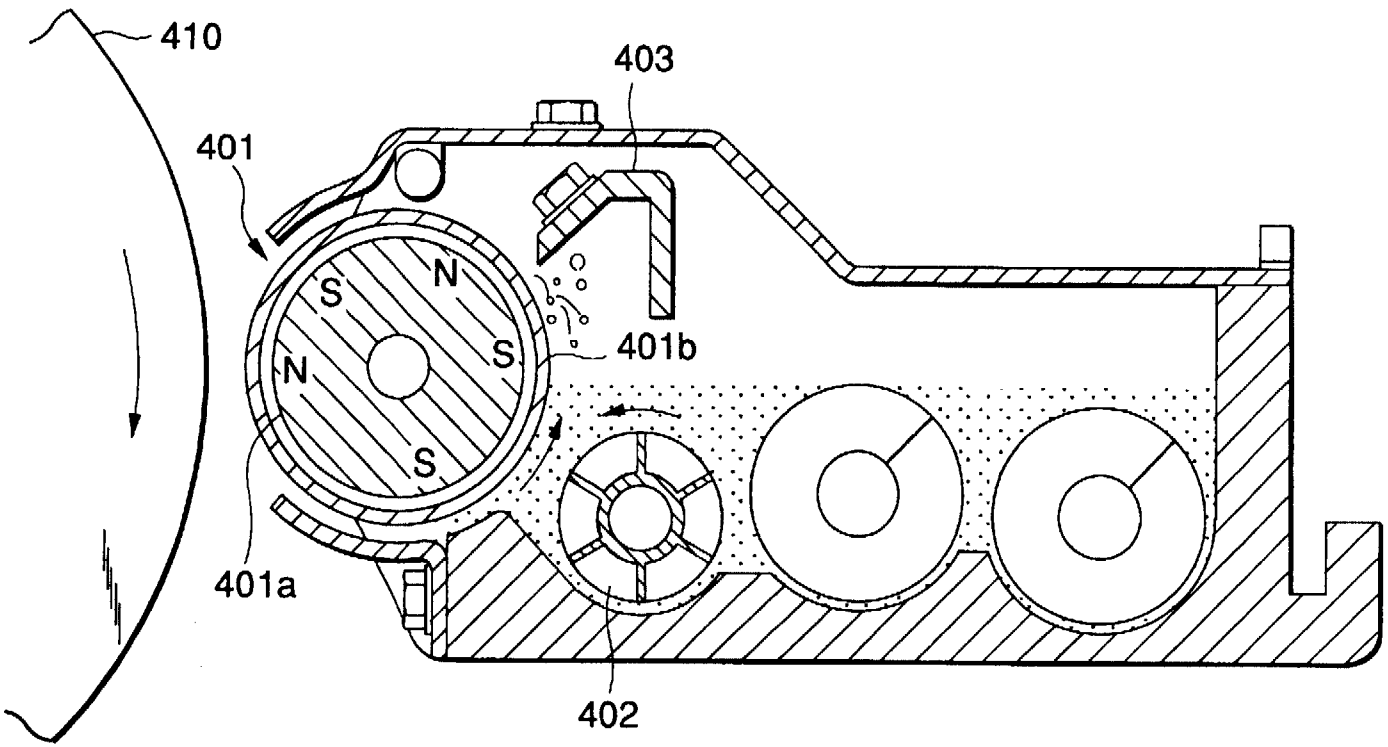
FIG. 33 is a schematic diagram to show a configuration example of a conventional developing apparatus.

On the other hand, at the rear of the developing roll 102, namely, on the side opposite to the side facing the photosensitive drum 1, contactors 103 are pressed at both ends of the developing roll 102, as shown in FIG. 32. The DC component of the developing bias voltage and the voltage comprising DC voltage superposed on the DC component of the developing bias voltage are inverted cyclically and applied alternately to the adjacent electrodes via the contactors.

In the developing apparatus, formation of a thin layer of the developer and stripping off the developer from the developing roll 102 are also executed as in the developing apparatus shown in FIG. 27, whereby degradation of the developer is decreased.

[12. Modifications of the Embodiments]

The embodiments of the invention are not limited to those we have discussed. For example, the invention can be embodied by changing setting, conditions, etc., on the following items:

- The travel speed of the peripheral surface of the image support is set to 320 mm/s in the embodiments. However, the developer layer formation state does not depend on the travel speed of the peripheral surface; a uniform developer layer can be formed at a travel speed in the range of 10 mm/s to 900 mm/s and when the developer support rotates, the developer does not scatter.
- The move direction of the peripheral surface of the image support is a direction opposite to the move direction of the peripheral surface of the electrostatic latent image support (photosensitive drum). However, the invention is not limited to it and they may be the same direction.
- The developing bias voltage is AC voltage on which DC voltage is superposed and the waveform of the AC voltage is rectangular. However, the invention is not limited to it and any desired developing bias voltage can be used in response to the purpose and application.

The embodiments provide single-color image recorders, but can also be applied to a color image recorder for forming a color image in plurality of color toners on an electrostatic latent image support and transferring the toner image onto recording paper in batch.

Although the embodiments use photosensitive bodies as the electrostatic latent image supports, a dielectric substance may be used as an electrostatic latent image support for forming an electrostatic latent image by a discharge recording head used with an electrostatic printer, an ion flow control head disclosed in Japanese Patent Laid-Open No. Sho 59-190854, or the like, for example.

As we have discussed, the developing apparatus of the invention has S and N poles magnetized alternately at small pitches in the peripheral surface of the developer support, whereby carriers of a dual component developer can be magnetically attracted on the peripheral surface of the developer support as a thin layer, whereby a thin layer of the developer can be formed on the peripheral surface of the developer support and be made available for developing without using a layer thickness regulation member, etc., and degradation of the developer can be decreased. Since the developer layer can be thinned, the gap between the developer support and the electrostatic latent image support can be lessened for executing high-speed developing of high image quality.

On the other hand, as another configuration, linear or elongated electrodes are formed in parallel at small pitches on the peripheral surface of the developer support and a voltage is applied between the adjacent electrodes, whereby carriers of a dual component developer can be electrically attracted on the peripheral surface of the developer support as a thin layer, whereby a thin layer of the developer can be formed on the peripheral surface of the developer support and be made available for developing without using a layer thickness regulation member, etc., and degradation of the developer can be decreased.

At the position where the developer layer passing through the developing area is stripped off from the surface of the image support, the direction of the voltage applied between the adjacent electrodes is inverted cyclically, whereby the developer can be stripped off without using a scraper, etc., whereby degradation of the developer can also be decreased.

Further, the developer support is formed with both the magnetic poles and the electrodes, whereby developer attraction means, namely, a magnetic force or an electric force can be selected in a portion where the developer is attracted and a thin layer is formed, the developing area, the developer stripping off area, etc., and the electric force in addition to the magnetic force can be made to act on the developer stripping off area.

Then, the developer is attracted by the magnetic force and the developing bias voltage is applied almost uniformly in the developing area, and after the developer passes through the developing area, it can also be stripped off from the surface of the image support by the electric force.

What is claimed is:

1. A developing apparatus comprising:

a developer support being disposed in the proximity of or in contact with an image support having a surface on which an electrostatic latent image is formed, said developer support having a peripheral surface supported turnably; and a developing bias power supply for supplying a developing bias voltage between said developer support and said image support, wherein a dual component developer including toner and magnetic carriers is supported on the peripheral surface of said developer support to be transported, and the toner is transferred to said image support in an electric field formed at a position where said image support faces said developer support for forming a toner image, said developer support has a plurality of magnetic poles for attracting almost one layer of the carriers on the peripheral surface of said developer support almost uniformly, said plurality of magnetic poles are placed as an alternating pattern of S and N poles, and a distance between centers of positions corresponding to said magnetic poles, of a magnetic field formed in the vicinity of the peripheral surface of said developer support ranges from 25 μm to 250 μm.

2. The developing apparatus of claim 1, wherein the magnetic carriers of said developer supported on the peripheral surface of said developer support have magnetization in a magnetic field of $10^6/(4\pi)$ A/m ranging from about 45 kA/m to 360 kA/m.

3. The developing apparatus of claim 1, wherein said developer support comprises;

a conductive layer, and a magnetic recording layer formed therein.

4. The developing apparatus of claim 1, wherein said developer support comprises:

a soft magnetic layer, and a magnetic recording layer formed thereon.

5. The developing apparatus of claim 1, wherein said developer support comprises;

said plurality of magnetic poles almost equally spaced from each other over all area in a turn direction, said magnetic poles turning.

6. The developing apparatus of claim 1, wherein said developer support comprises;

an internal member provided with said plurality of magnetic poles; and an outer peripheral member turning around a periphery of said internal member.

7. The developing apparatus of claim 6, wherein said internal member is fixedly supported, and has said plurality of magnetic poles at least in a portion where the developer is attracted to form a developer layer.

8. A developing apparatus comprising:

a developer support being disposed in the proximity of or in contact with an image support having a surface on which an electrostatic latent image is formed, said developer support having a peripheral surface supported turnably;

a developing bias power supply for supplying a developing bias voltage between said developer support and said image support; and electric field formation means for forming an electric field for attracting almost one layer of carriers on the peripheral surface of said developer support almost uniformly wherein said electric field formation means comprises:

a plurality of linear of elongated electrodes disposed in a portion along the peripheral surface of said developer support, and a power supply for applying a voltage so as to produce a potential difference of 0.8 V or more per μm between adjacent electrodes, wherein a dual component developer comprising toner and carriers made of a high-resistance material is supported on the peripheral surface of said developer support to be transported, and the toner is transferred to said image supported in an electric field formed at a position where said image support faces said developer support for forming a toner image.

9. The developing apparatus of claim 8, wherein a distance between centers of said adjacent electrodes ranges from 25 μm to 200 μm.

10. The developing apparatus of claim 8, wherein said plurality of electrodes are formed like lines or elongated bands in a direction at right angles to a circumferential direction of said developer support, and are almost equally spaced from each other over all area in the circumferential direction.

11. The developing apparatus of claim 10, further comprising:

inverting electric field generation means for cyclically inverting a direction of an electric field between said adjacent electrodes downstream from the position where said developer support faces said image support in the turn direction of said developer support, wherein said plurality of electrodes are disposed so as to move as the peripheral surface of said developer support turns.

12. The developing apparatus of claim 11, wherein a magnetic recording layer is superposed on said plurality of electrodes disposed in the peripheral surface of said developer support, wherein a plurality of S and N poles are magnetized alternately in an almost equal spacing in the circumferential direction on said magnetic recording layer.

13. The developing apparatus of claim 10, wherein said developer support comprises;

an internal member having a plurality of magnetic poles, and an outer peripheral member turned around a periphery of said internal member, said outer peripheral member being provided with said plurality of electrodes.

14. The developing apparatus of claim 13, wherein:

said plurality of magnetic poles disposed in said internal member are placed as an alternating pattern of S and N poles, and are magnetized so that a distance between centers of the adjacent magnetic poles ranges from 25 μm to 250 μm.

15. The developing apparatus of claim 13, wherein said magnetic poles of said internal member are magnetized linearly in the direction at right angles to the turn direction of said developer support, and are almost equally spaced from each other in the turn direction, one of a distance between centers of said adjacent electrodes disposed in said outer peripheral member and a distance between centers of the adjacent magnetic poles in an integer multiple of the other, and an outer peripheral surface of said internal member and said outer peripheral member are driven so as to turn, and are set to almost equal travel speed.

16. The developing apparatus of claim 10, wherein said developer support comprises;

an internal member having said plurality of electrodes on a peripheral surface, and an outer peripheral member turned around a periphery of said internal member, said outer peripheral member being provided with an alternating pattern of magnetic poles different in polarity on a peripheral surface.

17. The developing apparatus of claim 16, wherein a distance between centers of said adjacent magnetic poles of said outer peripheral member ranges from 25 μm to 250 μm, and a distance between centers of said adjacent electrodes disposed in said internal member ranges from 25 μm to 350 μm.

18. The developing apparatus of claim 16, wherein said magnetic poles of said outer peripheral member are magnetized as an alternating pattern of S and N poles equally spaced from each other in the circumferential direction of said developer support, one of a distance between centers of said adjacent electrodes in the circumferential direction disposed in said internal member and a distance between centers of said adjacent magnetic poles is an integer multiple of the other, and a travel speed of an inner peripheral surface of said outer peripheral member and a travel speed of an outer peripheral surface of said internal member are set almost equally.

19. A developing apparatus comprising:

a developer support being disposed in the proximity of or in contact with an image support having a surface on which an electrostatic latent image is formed, said developer support having a peripheral surface supported turnably; and a developing bias power supply for supplying a developing bias voltage between said developer support and said image support, wherein a dual component developer including toner and magnetic carrier is supported on the peripheral surface of said developer support to be transported, and the toner is transferred to said image support in an electric field formed at a position where said image support faces said developer support for forming a toner image, and said developer support comprises a soft magentic layer, and a magnetic recording layer formed thereon.

* * * * *